US006607427B2

(12) United States Patent
Togawa et al.

(10) Patent No.: US 6,607,427 B2
(45) Date of Patent: Aug. 19, 2003

(54) DRESSING APPARATUS AND POLISHING APPARATUS

(75) Inventors: Tetsuji Togawa, Kanagawa-ken (JP); Osamu Nabeya, Kanagawa-ken (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/988,329

(22) Filed: Nov. 19, 2001

(65) Prior Publication Data

US 2002/0086623 A1 Jul. 4, 2002

(30) Foreign Application Priority Data

Nov. 17, 2000 (JP) ..... 2000-350820

(51) Int. Cl.[7] ..... B24B 1/00
(52) U.S. Cl. ..... 451/56; 451/443
(58) Field of Search ..... 451/41, 56, 285–289, 451/443, 444

(56) References Cited

U.S. PATENT DOCUMENTS 5,779,526 A * 7/1998 Gill ..... 451/324
5,785,585 A * 7/1998 Manfredi et al. ..... 451/288
5,938,507 A * 8/1999 Ko et al. ..... 451/56
6,306,019 B1 * 10/2001 Finkelman ..... 451/56
6,309,290 B1 * 10/2001 Wang et al. ..... 451/398
6,312,319 B1 * 11/2001 Donohue et al. ..... 451/56
6,325,709 B1 * 12/2001 Nanda et al. ..... 451/443
6,328,637 B1 * 12/2001 Labunsky et al. ..... 451/56
6,343,977 B1 * 2/2002 Peng et al. ..... 451/56
6,354,918 B1 * 3/2002 Togawa et al. ..... 451/56
6,361,411 B1 * 3/2002 Chopra et al. ..... 451/56
6,364,752 B1 * 4/2002 Kimura et al. ..... 451/56
6,453,899 B1 * 9/2002 Tselesin ..... 125/15

OTHER PUBLICATIONS

U.S. patent application Ser. No. 09/663,417, filed Sep. 15, 2000 (Kunihiko Sakurai et al.).

U.S. patent application Ser. No. 09/572,629, filed May 17, 2000 (Satoshi Wakabayashi et al.).

* cited by examiner

*Primary Examiner*—Lee D. Wilson
*Assistant Examiner*—David B. Thomas
(74) *Attorney, Agent, or Firm*—Wenderoth, Lind & Ponack, L.L.P.

(57) ABSTRACT

A dressing apparatus dresses a polishing surface of a polishing table used for polishing a workpiece such as a semiconductor wafer in a polishing apparatus. The dressing apparatus comprises a dresser having an elongate dressing surface for dressing the polishing surface, and the dressing surface has a flat surface which contacts the polishing surface. The dressing surface also has one of a tapered surface extending from the flat surface and inclined so as to be directed away from the polishing surface and a curved surface extending from the flat surface and curved so as to be directed away from the polishing surface.

32 Claims, 16 Drawing Sheets

DRESSING APPARATUS AND POLISHING APPARATUS

BACKGROUND OF THE INVENTION

1. Field of the Invention

The present invention relates to a dressing apparatus for dressing a polishing surface of a polishing table used for polishing a workpiece such as semiconductor wafer in a polishing apparatus, and a polishing apparatus, having such a dressing apparatus, for polishing a workpiece such as a semiconductor wafer to a flat mirror finish.

2. Description of the Related Art

Recently, semiconductor device have become more integrated, and structure of semiconductor elements has become more complicated. In addition, as the number of layers in multilayer interconnections used for a logical system has been increased, irregularities of a surface of a semiconductor device are increased, so that a step height on the surface of the semiconductor device becomes larger. This is because in manufacturing semiconductor devices, a process for forming a thin film is performed and a micromachining process such as patterning or formation of holes is performed, and then a process for forming a subsequent film is performed, and these processes are repeated many times.

When the irregularities of the surface of the semiconductor device are increased, the following problems arise. Thickness of a film formed in a portion having a step is relatively small. An open circuit is caused by disconnection of interconnections, or a short circuit is caused by insufficient insulation between layers. As a result, good products cannot be obtained, and yield is reduced. Further, even if a semiconductor device initially works normally, reliability of the semiconductor device is lowered after a long-term use.

Another problem is caused with regard to a lithography process by irregularities of a surface of the semiconductor device. Specifically, at a time of exposure during the lithography process, if an irradiation surface has irregularities, then a lens unit of an exposure system is locally unfocused. Therefore, if the irregularities of the surface of the semiconductor device are increased, then it is difficult to form a fine pattern on the semiconductor device.

Thus, during a manufacturing process of a semiconductor device, it is increasingly important to planarize a surface of the semiconductor device. The most important one of planarizing technologies is chemical mechanical polishing (CMP). During chemical mechanical polishing, in which a polishing apparatus is used, while a polishing liquid containing abrasive particles such as silica ($SiO_2$) therein is supplied onto a polishing surface such as a polishing pad, a substrate such as a semiconductor wafer is brought into sliding contact with the polishing surface, thereby polishing a surface of the substrate.

Conventionally, as shown in FIG. 17, such a polishing apparatus has a polishing table 102 having a polishing cloth (polishing pad) 100 attached to an upper surface thereof, and a top ring 104 for holding a substrate W, such as a semiconductor wafer, and pressing the substrate W against the polishing cloth 100 on the polishing table 102. A polishing liquid containing abrasive particles is supplied form a nozzle 106 onto the polishing cloth 100 and retained on the polishing cloth 100. The polishing cloth 100 on the polishing table 102 constitutes a polishing surface of the polishing table. During operation, the top ring 104 exerts a certain pressure, and a surface of the substrate W held against the polishing surface of the polishing table 102 is therefore polished to a flat mirror finish while the top ring 104 and the polishing table 102 are rotating. The polishing liquid comprises abrasive particles such as silica particles, and chemical solution such as alkali solution in which the abrasive particles are suspended. Thus, the substrate W is chemically and mechanically polished by a combination of a mechanical polishing action of abrasive particles in the polishing liquid and a chemical polishing action of chemical solution in the polishing liquid.

When a polishing process is finished, polishing capability of the polishing cloth 100 is gradually deteriorated due to a deposition of abrasive particles and ground-off particles removed from the substrate, and due to changes in characteristics of a surface of the polishing cloth. Therefore, if the same polishing cloth is used to repeatedly polish substrates W, a polishing rate of the polishing apparatus is lowered, and polished substrates tend to suffer polishing irregularities. Therefore, it has been customary to condition the polishing cloth according to a process called "dressing" for recovering the surface of the polishing cloth before, after, or during polishing.

In order to dress the surface of the polishing cloth 100 which has been deteriorated by polishing, a dressing apparatus 108 having a dressing surface is provided adjacent to the polishing table 102. In operation, the dressing surface of the dressing apparatus 108 is pressed against the polishing surface of the polishing table 102, and the dressing surface and the polishing table 102 are rotated relatively to each other for thereby bringing the dressing surface into sliding contact with the polishing surface. Thus, polishing liquid and ground-off particles attached to the polishing surface are removed, and planalization and regeneration of the polishing surface are conducted.

In order to primarily remove the polishing liquid and the ground-off particles from the polishing surface, a dressing apparatus having a dressing surface composed of a nylon brush is mainly used. In order to primarily planalize the polishing surface by slightly scraping the polishing surface, a dressing apparatus having a diamond dresser is mainly used. Uniformity of the polishing surface which has been dressed greatly affects polishing precision of a workpiece (substrate).

However, the above-mentioned polishing apparatus has the following problems:

A first problem is that in case of polishing a substrate by a polishing table which rotates about its own axis, there is no relative movement between a polishing surface and the substrate relative to a rotational center of the polishing table, and hence the substrate is polished on an area of the polishing surface spaced from the rotational center of the polishing table. Therefore, a diameter of the polishing table should be at least two times a diameter of the substrate. Thus, size of the polishing apparatus becomes large, whereby a large installation space of the polishing apparatus is required, and cost of facilities is high. This drawback is becoming significant with increasing diameters of substrates.

A second problem is presented by a polishing cloth made of material having elasticity, such as urethane. In general, a device pattern on an upper surface of a semiconductor wafer (substrate) has various irregularities having various dimensions and steps, and is composed of different material. When the semiconductor wafer having step-like irregularities is planarized by a polishing cloth having elasticity, not only raised regions but also depressed regions are polished, and hence a large amount of material is removed from the semiconductor wafer and a long period of time is required until the semiconductor wafer is planarized. Thus, an operation cost associated with such a polishing process is increased, and irregularities of a polished surface of the semiconductor wafer are difficult to be eliminated, with a result that a high flatness of the polished surface cannot be obtained. Further, regions on which microscopic irregularities are concentrated are polished at a high polishing rate, and regions on which macroscopic irregularities exist are polished at a low polishing rate. Thus, a large undulation is formed on the polished surface of the semiconductor wafer.

A third problem is presented by operation costs associated with a polishing process and environmental pollution. In order to polish a semiconductor wafer to a high degree of flatness, a polishing liquid needs to be supplied abundantly onto a polishing cloth. However, supplied polishing liquid is discharged from the polishing cloth at a high rate without being used during an actual polishing process. This leads to a high operating cost associated with the polishing process because the polishing liquid is expensive. Further, since the polishing liquid contains a large amount of abrasive particles such as silica particles, and may contain chemicals such as acids or alkalis to thus form slurry-like material, it is necessary to treat waste liquid discharged from the polishing process for thereby preventing environmental pollution. This also leads to a high operating cost associated with the polishing process.

In order to solve the first problem, it is conceivable that the polishing apparatus incorporates a polishing table which makes a circulative translational motion (scroll motion) along a circle having a certain radius. In this case, every point on a polishing surface of the polishing table makes the same motion, and hence a diameter of the polishing surface on the polishing table may be equal to a dimension obtained by adding twice a radius of gyration of the polishing table to a diameter of a semiconductor wafer (substrate).

Thus, the polishing apparatus may be small in size such that installation space of the polishing apparatus may be reduced to lower overall costs, including manufacturing costs of the polishing apparatus, operating costs in a plant and cost of equipment.

In order to solve the second and third problems, it is conceivable to polish semiconductor wafers (substrates) by using an abrading plate. The abrading plate comprises abrasive particles such as silica particles and a binder for binding the abrasive particles, and is flat. The abrading plate may be called a fixed abrasive. The abrading plate is attached to an upper surface of a polishing table, and a semiconductor wafer held by a top ring is pressed against the abrading plate under a certain pressure and brought into sliding contact with the abrading plate. With sliding contact between the abrading plate and the semiconductor wafer, the semiconductor wafer is polished while the binder is broken or dissolved to thus generate fresh freed abrasive particles.

According to the above polishing process, the abrading plate is harder than a polishing cloth and has less elastic deformation than does a polishing cloth, and hence only raised regions on a semiconductor wafer are polished and undulation of a polished surface of the semiconductor wafer is prevented from being formed. Further, since a slurry-like polishing liquid containing a large amount of abrasive particles is not used, an amount of wafers discharged from the polishing process, and required to be treated, is greatly reduced, and hence an operating cost is reduced and environmental protection is easily carried out. Since a polishing liquid containing abrasive particles is not used, equipment for supplying such polishing liquid is not required.

In a case where an abrading plate is attached to a polishing table which makes a circulative translational motion (scroll motion), and a substrate is polished by the abrading plate, a polishing surface of the abrading plate includes a central region which is always in contact with the substrate while being polished, a peripheral region which is always not in contact with the substrate while being polished, and an intermediate region which is brought into contact with or out of contact with the substrate while being polished. As a result, as shown in FIG. 18, a surface of abrading plate 110, i.e. a polishing surface 110*a*, has a depressed region. That is, a central region A of the polishing surface suffers a large abrasion loss, a peripheral region C suffers hardly any abrasion loss, and an intermediate region B suffers an inclined abrasion loss. Even if a substrate (semiconductor wafer) continues to be polished by the polishing surface shown in FIG. 18, the substrate cannot be planarized. Thus, it is necessary to dress the polishing surface of the abrading place.

In such a case, if dressing of the polishing surface is conducted by a dressing tool having a circular dressing surface or an annular dressing surface smaller than the polishing surface, as in the case of conventional dressing process, then the polishing surface of the abrading plate having irregularities is locally dressed, and hence it is difficult to planarize an entire area of the polishing surface. These circumstances hold true for a dressing process of a polishing surface composed of a polishing cloth attached to a polishing table which makes a circulative transnational motion (scroll motion).

SUMMARY OF THE INVENTION

It is therefore an object of the present invention to provide a dressing apparatus which can easily and reliably planarize a polishing surface, having irregularities, on a polishing table and regenerate the polishing surface efficiently.

Another object is to provide a dressing apparatus which can dress a polishing surface of a polishing table, which makes a circulative transnational motion (scroll motion or circulative orbital motion) and has an advantage of a small installation space, by a dresser which requires a small installation space, and can increase a processing capability of the polishing table per unit installation area.

According to a first aspect of the present invention, there is provided a dressing apparatus for dressing a polishing surface of a polishing table for polishing a surface of a workpiece. The dressing apparatus comprises a dresser having an elongate dressing surface for dressing the polishing surface. The dressing surface has a flat surface which contacts the polishing surface, and one of a tapered surface extending from the flat surface and inclined so as to be directed away from the polishing surface and a curved surface extending from the flat surface and curved so as to be directed away from the polishing surface.

According to a second aspect of the present invention, there is provided a dressing apparatus for dressing a polishing surface of a polishing table for polishing a surface of a workpiece. The dressing apparatus comprises a dresser having an elongate dressing surface for dressing the polishing surface, wherein the dressing surface comprising a circulate arc surface.

According to a first and second aspects of the present invention, because a boundary portion between a contact portion and a non-contact portion of the dressing surface and the polishing surface has a smooth shape, a stick-slip caused between the dressing surface and the polishing surface can be decreased, and the dresser can be smoothly moved. Thus, generation of vibration of the dresser can be suppressed.

According to the present invention, a long side of the dressing surface has a dimension larger than that of a moving area of the polishing surface of the polishing table, and the dresser is movable along the polishing surface via a horizontally moving mechanism. Thus, an entire area of the polishing surface can be dressed by bringing the dressing surface into contact with the polishing surface and moving the dressing surface. Therefore, even if the polishing surface has local irregularities, the entire area of the polishing surface can be reliably planalized, and the polishing surface can be efficiently and uniformly regenerated.

Further, the long side of the dressing surface must have a dimension equal to or larger than that of the moving area of the polishing table, i.e. a dimension obtained by adding a scroll diameter to a diameter of the polishing table. However, a short side of the dressing surface may be as small as possible, provided that such is permitted by dressing conditions. Thus, a rectangular dresser can save installation space, compared with a circular dresser.

The horizontally moving mechanism may comprise a translation mechanism for causing the dresser to perform a translation along the polishing surface at a constant velocity. With this structure, relative vectors on a contact surface between the dressing surface and the polishing surface, which makes a scrolling motion, are equalized over an entire polishing surface, and contact time between the dressing surface and the polishing surface is equalized over the entire polishing surface, and hence uniform dressing can be performed.

According to a third aspect of the present invention, there is provided a dressing apparatus for dressing a polishing surface of a polishing table for polishing a surface of a workpiece. The dressing apparatus comprises a dresser having a dressing surface for dressing the polishing surface, and a controller for controlling a pressing force for pressing the dresser against the polishing surface such that when a contact area between the dressing surface of the dresser and the polishing surface is changed by relative movement between the dresser and the polishing table during dressing, the pressing force is changed by the controller according to the contact area.

According to the present invention, because a contact area between the dressing surface and the polishing surface is changed by relative movement between the dresser and the polishing table during dressing, and a pressing force of the dresser applied to the polishing table (pressing force applied to an entire dressing surface) is changed by the controller according to the contact area, a pressing force for pressing the dressing surface against the polishing surface (pressure applied to the polishing surface per unit area) can be equalized over an entire polishing surface. Thus, an amount of a material removed from the polishing surface on the polishing table can be uniformized over the entire polishing surface.

According to a fourth aspect of the present invention, there is provided a dressing apparatus for dressing a polishing surface of a polishing table for polishing a surface of a workpiece. The dressing apparatus comprises a dresser having a dressing surface for dressing the polishing surface. The dressing surface has a flat surface which contacts the polishing surface, and one of a tapered surface extending from the flat surface and inclined so as to be directed away from the polishing surface and a curved surface extending from the flat surface and curved so as to be directed away from the polishing surface, and the dresser performs no rotational motion about its own axis during dressing.

According to fifth aspect of the present invention, there is provided a dressing apparatus for dressing a polishing surface of a polishing table for polishing a surface of a workpiece. The dressing apparatus comprises a dresser having a dressing surface for dressing the polishing surface. The dressing surface comprises a circular arc surface, wherein the dresser performs no rotational motion about its own axis during dressing.

In a preferred aspect of the present invention, a dresser cleaning container is provided to clean the dressing surface of the dresser. If the dresser cleaning container is of an elongate shape so as to correspond to a shape of a rectangular dresser, the dresser cleaning container can save installation space. Further, foreign matter attached to the dressing surface, or fragments of the dresser element such as diamond particles, are removed from the dresser, thereby eliminating harmful influence of the polishing surface caused by such fragments and foreign matter.

According to a sixth aspect of the present invention, there is provided a polishing apparatus for polishing surface of a workpiece. The polishing apparatus comprises a polishing table having a polishing surface, and a dresser having a dressing surface for dressing the polishing surface. The dresser is movable along the polishing surface via a moving mechanism, and a shape of the polishing surface is arranged such that a contact area between the dressing surface of the dresser and the polishing surface is not changed when the dresser is moved by the moving mechanism.

According to the present invention, a contact area between the dressing surface of the dresser and the polishing surface is not changed over an entire area where the dresser moves. Thus, a pressing force for pressing the dresser against the polishing surface can be constant, irrespective of a position of the dresser. Shape and size of the polishing surface are set such that the polishing surface is contained in a locus described by an outer periphery of the dresser. As an example of a shape of the polishing surface, the polishing surface is generally rectangular, and a dimension of at least one side of the generally rectangular polishing surface is shorter than a dimension of a long side of the dresser. A moving direction of the dresser is perpendicular to the at least one side of the polishing surface and a moving distance of the dresser is shorter than a dimension of another side of the polishing surface.

According to a seventh aspect of the present invention, there is provided a polishing apparatus for polishing a surface of a workpiece, comprising: a polishing table having a polishing surface; a workpiece holder for holding a workpiece; a pressing device for pressing the workpiece held by the workpiece holder against the polishing surface; and a dressing apparatus for dressing the polishing surface. The dressing apparatus includes the dresser of the above first through fifth aspects of the present invention.

The above and other objects, features, and advantages of the present invention will be apparent from the following description when taken in conjunction with the accompanying drawings which illustrate preferred embodiments of the present invention by way of example.

DETAILED DESCRIPTION OF THE PREFERRED EMBODIMENTS

Next, a dressing apparatus and a polishing apparatus having such dressing apparatus according to embodiments of the present invention will be described below with reference to drawings.

Figure 1:
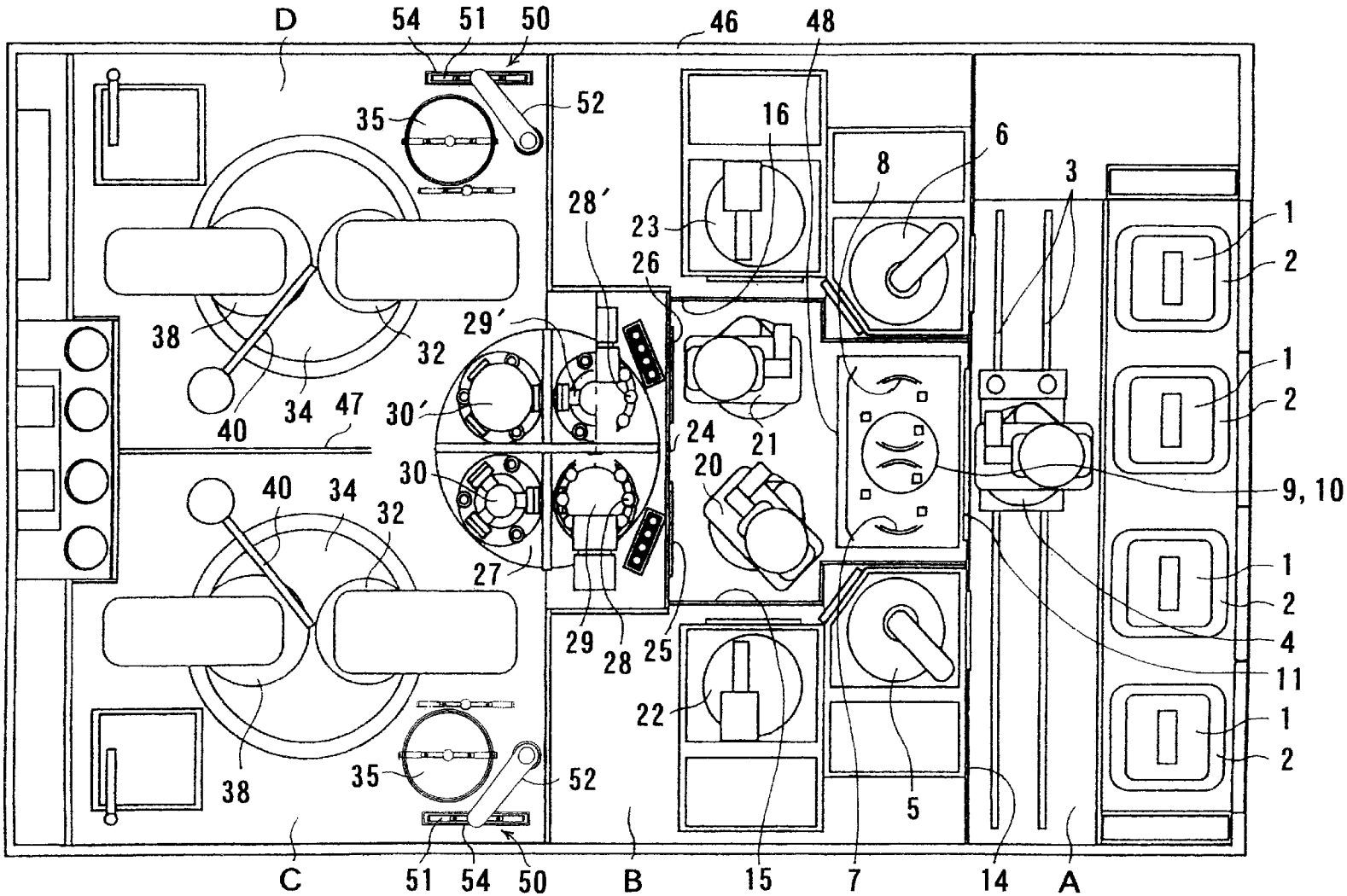
FIG. 1 is a plan view showing a layout of various components of a polishing apparatus according to an embodiment of the present invention.
Figure 2:
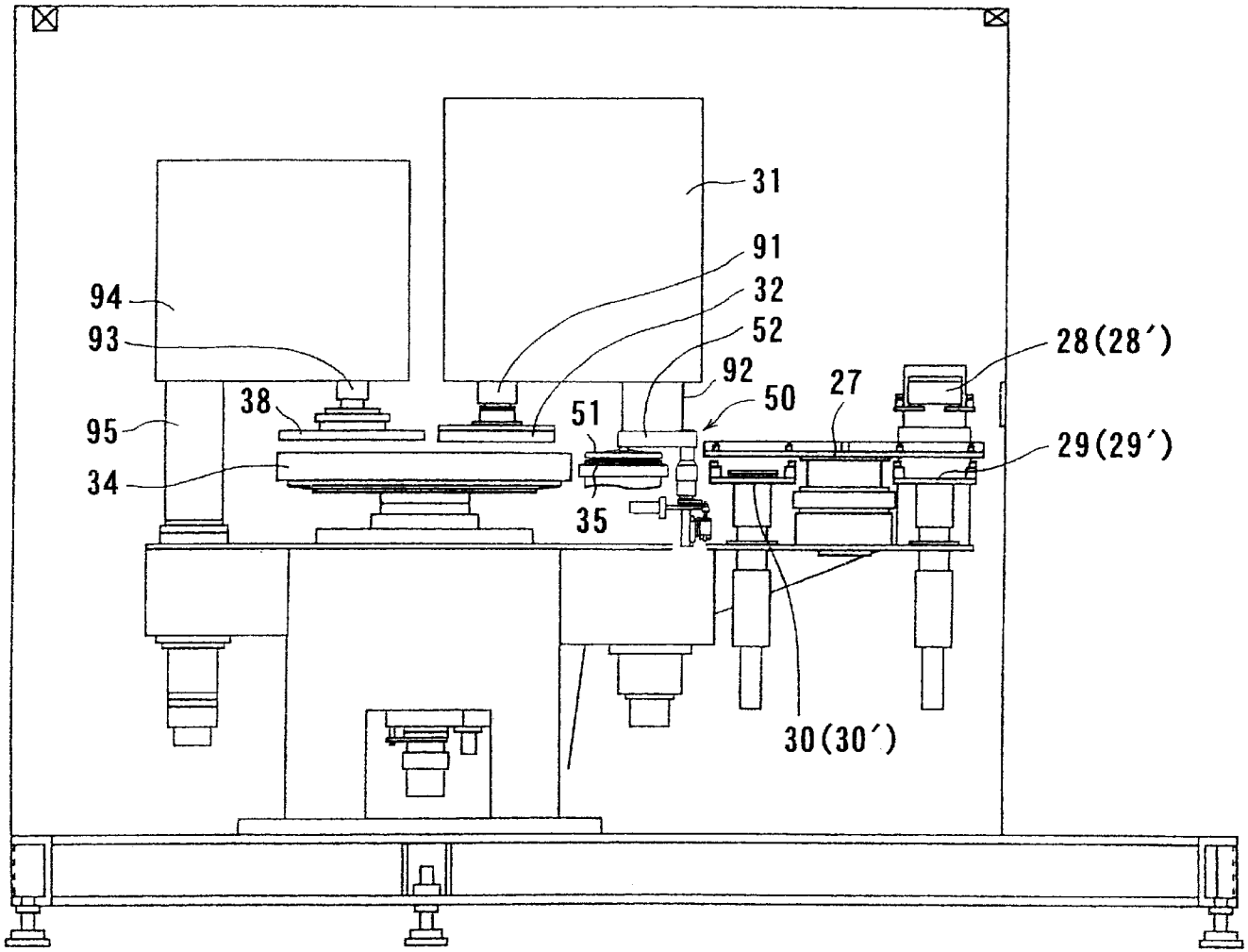
FIG. 2 is an elevational view showing the polishing apparatus shown in FIG. 1.

FIG. 1 is a plan view showing a layout of various components of a polishing apparatus according to an embodiment of the present invention. FIG. 2 is an elevational view showing the polishing apparatus shown in FIG. 1. As shown in FIG. 1, a polishing apparatus according to the present invention comprises four load-unload stages each for receiving a wafer cassette 1 which accommodates a plurality of semiconductor wafers. A load-unload stage 2 may have a mechanism for raising and lowering a respective wafer cassette 1. A transfer robot 4 having two hands is provided on rails 3 so that the transfer robot 4 can move along the rails 3 and access the respective wafer cassettes 1 on the respective load-unload stages 2.

Two cleaning apparatuses 5 and 6 are disposed at an opposite side of the wafer cassettes 1 with respect to the rails 3 of the transfer robot 4. The cleaning apparatuses 5 and 6 are disposed at positions that can be accessed by the hands of the transfer robot 4. Between the two cleaning apparatuses 5 and 6 and at a position that can be accessed by the transfer robot 4, there is provided a wafer station 48 having four wafer supports 7, 8, 9 and 10. The cleaning apparatuses 5 and 6 have a spin-dry mechanism for drying a semiconductor wafer by spinning the semiconductor wafer at a high speed, and hence two-stage cleaning or three-stage cleaning of the semiconductor wafer can be conducted without replacing any cleaning module.

An area B in which the cleaning apparatuses 5 and 6 and the wafer station 48 having the wafer supports 7, 8, 9 and 10 are disposed, and an area A in which the wafer cassettes 1 and the transfer robot 4 are disposed, are partitioned by a partition wall 14 so that cleanliness of area B and area A can be separated. The partition wall 14 has an opening for allowing semiconductor wafers to pass therethrough, and a shutter 11 is provided at the opening of the partition wall 14. A transfer robot 20 having two hands is disposed at a position where the transfer robot 20 can access the cleaning apparatus 5 and three wafer supports 7, 9 and 10, and a transfer robot 21 having two hands is disposed at a position where the transfer robot 21 can access the cleaning apparatus 6 and three wafer supports 8, 9 and 10.

The wafer support 7 is used to transfer a semiconductor wafer between the transfer robot 4 and the transfer robot 20. The wafer support 8 is used to transfer a semiconductor wafer between the transfer robot 4 and the transfer robot 21. The wafer support 9 is used to transfer a semiconductor wafer from the transfer robot 21 to the transfer robot 20. The wafer support 10 is used to transfer a semiconductor wafer from the transfer robot 20 to the transfer robot 21.

A cleaning apparatus 22 is disposed at a position adjacent to the cleaning apparatus 5 and is accessible by the hands of the transfer robot 20, and another cleaning apparatus 23 is disposed at a position adjacent to the cleaning apparatus 6 and is accessible by the hands of the transfer robot 21.

The cleaning apparatuses 5, 6, 22 and 23, the wafer supports 7, 8, 9 and 10 of the wafer station 48, and the transfer robots 20 and 21 are placed in area B. Pressure in area B is adjusted so as to be lower than pressure in area A. Each of the cleaning apparatuses 22 and 23 is capable of cleaning both surfaces of a semiconductor wafer.

The polishing apparatus shown in FIG. 1 has a housing 46 for enclosing various components therein. The housing 46 constitutes an enclosing structure. An interior of the housing 46 is partitioned into a plurality of compartments or chambers (including areas A and B) by partitions 14, 15, 16, 24 and 47.

A polishing chamber separated from area B by the partition wall 24 is formed, and is further divided into two areas C and D by the partition wall 47. In each of the two areas C and D, there are provided a polishing table 34 which makes a rotating motion and a polishing table 35 which makes a scrolling motion. Further, in each of the two areas C and D, there are provided a top ring 32 for holding a semiconductor wafer and pressing the semiconductor wafer against the polishing tables 34, 35, a polishing liquid nozzle 40 for supplying a polishing liquid to the polishing table 34, a dresser 38 for dressing the polishing table 34, and a dressing apparatus 50 for dressing the polishing table 35.

FIG. 2 shows a relationship between each top ring 32 and respective polishing tables 34 and 35. As shown in FIG. 2, the top ring 32 is supported from a top ring head 31 by a top ring drive shaft 91 which is rotatable. The top ring head 31 is supported by a support shaft 92 which can be angularly positioned, and the top ring 32 can access the polishing tables 34 and 35 and a rotary transporter 27 (described later on). The dresser 38 is supported from a dresser head 94 by a dresser drive shaft 93 which is rotatable. The dresser head 94 is supported by an angularly positionable support shaft 95 for moving the dresser 38 between a standby position and a dressing position over the polishing table 34. The polishing table 34 and the dresser 38 are of such a type as to be rotatable about their own axes.

As shown in FIG. 1, the dressing apparatus 50 for dressing the polishing table 35 comprises an elongate dresser 51 for dressing a polishing surface on the polishing table 35 by translational motion along the polishing surface of the polishing table 35 which makes a scrolling motion, and a dresser cleaning container 54 for cleaning the dresser 51.

As shown in FIG. 1, in area C separated from area B by the partition wall 24 and at a position that can be accessed by the hands of the transfer robot 20, there is provided a reversing device 28 for reversing a semiconductor wafer, and at a position that can be accessed by the hands of the transfer robot 21, there is provided a reversing device 28' for reversing a semiconductor wafer. The partition wall 24 between area B and areas C, D has two openings each for allowing semiconductor wafers to pass therethrough. One of these two openings is used for transferring the semiconductor wafer to or from the reversing device 28, and the other of these two openings is used for transferring a semiconductor wafer to or from the reversing device 28'. Shutters 25 and 26 are provided at respective ones of the two openings of the partition wall 24.

A rotary transporter 27 is disposed below the reversing devices 28 and 28' and the top rings 32, for transferring semiconductor wafers between a cleaning chamber (area B) and a polishing chamber (areas C and D). The rotary transporter 27 has four stages for receiving semiconductor wafers thereon at equal angular intervals, and can hold a plurality of semiconductorwafers thereon at the same time. A semiconductor wafer which has been transported to the reversing device 28 or 28' is transferred to the rotary transporter 27 by actuating a lifter 29 or 29' disposed below the rotary transporter 27, when a center of one of the four stages of the rotary transporter 27 is aligned with a center of the semiconductor wafer held by the reversing device 28 or 28'. The semiconductor wafer placed on a stage of the rotary transporter 27 is transported to a position below one of the top rings 32 by rotating the rotary transporter 27 by an angle of 90°. At this time, the one of the top rings 32 is positioned above the rotary transporter 27 beforehand by a swinging motion thereof. The semiconductor wafer is transferred from the rotary transporter 27 to this top ring 32 by actuating a pusher 30 or 30', disposed below the rotary transporter 27, when a center of the top ring 32 is aligned with a center of the semiconductor wafer placed on the stage of the rotary transporter 27.

The semiconductor wafer transferred to the top ring 32 is held under vacuum by a vacuum attraction mechanism of this top ring 32, and transported to a corresponding one of the polishing tables 34. Thereafter, the semiconductor wafer is polished by a polishing surface comprising a polishing cloth or a grinding stone (or a fixed abrasive) attached to the corresponding one of the polishing tables 34. The polishing tables 35, which make a scrolling motion, are disposed at positions that can be accessed by the top rings 32, respectively. With this arrangement, a primary polishing of a semiconductor wafer can be conducted by one of the polishing tables 34, and then a secondary polishing of the semiconductor wafer can be conducted by a corresponding one of the polishing tables 35. Alternatively, depending on a kind of a film on a semiconductor wafer, the primary polishing of the semiconductor wafer can be conducted by one of the polishing tables 35, and then secondary polishing of the semiconductor wafer can be conducted by a corresponding one of the polishing tables 34. In this case, since the polishing table 35 has a smaller-diameter polishing surface relative to the polishing table 34, a grinding stone (or a fixed abrasive) which is more expensive than a polishing cloth is attached to the polishing table 35 to thereby conduct a primary polishing of the semiconductor wafer. On the other hand, a polishing cloth having a shorter life, but being cheaper than the grinding stone (or the fixed abrasive), is attached to the first polishing table 34 to thereby conduct a finish polishing of the semiconductor wafer. This arrangement or utilization may reduce a running cost of the polishing apparatus. If the polishing cloth is attached to the polishing table 34 and the grinding stone (or fixed abrasive) is attached to the polishing table 35, then such a polishing table system may be provided at a lower cost. This is because the grinding stone (or the fixed abrasive) is more expensive than the polishing cloth, and the price of the grinding stone (or the fixed abrasive) is substantially proportional to a diameter of the grinding stone. Further, since the polishing cloth has a shorter life than does the grinding stone (or the fixed abrasive), if the polishing cloth is used under a relatively light load such as a finish polishing, then the life of the polishing cloth is prolonged. Further, if a diameter of the polishing cloth is large, the chance or frequency of contact with the semiconductor wafer is distributed to thus provide a longer life, a longer maintenance period, and an improved productivity of semiconductor devices.

After a semiconductor wafer is polished by a polishing table 34 and before a corresponding top ring 32 moves to a corresponding polishing table 35, a cleaning liquid is supplied from cleaning liquid nozzles (not shown), disposed adjacent to the polishing table 34, to the semiconductor wafer held by the top ring 32 at a position where the top ring 32 is spaced from the polishing table 34. Because the semiconductor wafer is rinsed before moving to the polishing table 35, transfer of contamination between polishing tables is prevented to thus avoid cross contamination of the polishing tables.

Next, as an example of processes for polishing a semiconductor wafer with the polishing apparatus shown in FIG. 1, two cassette parallel processing will be described below.

That is, one semiconductor wafer is processed in the following route: wafer cassette 1→transfer robot 4→wafer support 7 of wafer station 48→transfer robot 20→reversing device 28→wafer stage for loading wafer onto rotary transporter 27→top ring 32→polishing table 34→top ring 32→wafer stage for unloading wafer onto rotary transporter 27→reversing device 28→transfer robot 20→cleaning apparatus 22→transfer robot 20→cleaning apparatus 5→transfer robot 4→wafer cassette 1.

Another semiconductor wafer is processed in the following route: wafer cassette 1→transfer robot 4→wafer support 8 of wafer station 48→transfer robot 21→reversing device 28'→wafer stage for loading wafer onto rotary transporter 27→top ring 32→polishing table 34→top ring 32→wafer stage for unloading wafer onto rotary transporter 27→reversing device 28'→transfer robot 21→cleaning apparatus 23→transfer robot 21→cleaning apparatus 6→transfer robot 4→wafer cassette 1.

Next, a detailed structure of each dressing apparatus 50 for dressing a corresponding dressing table 35 will be described with reference to FIGS. 3 through 11.

Figure 3:
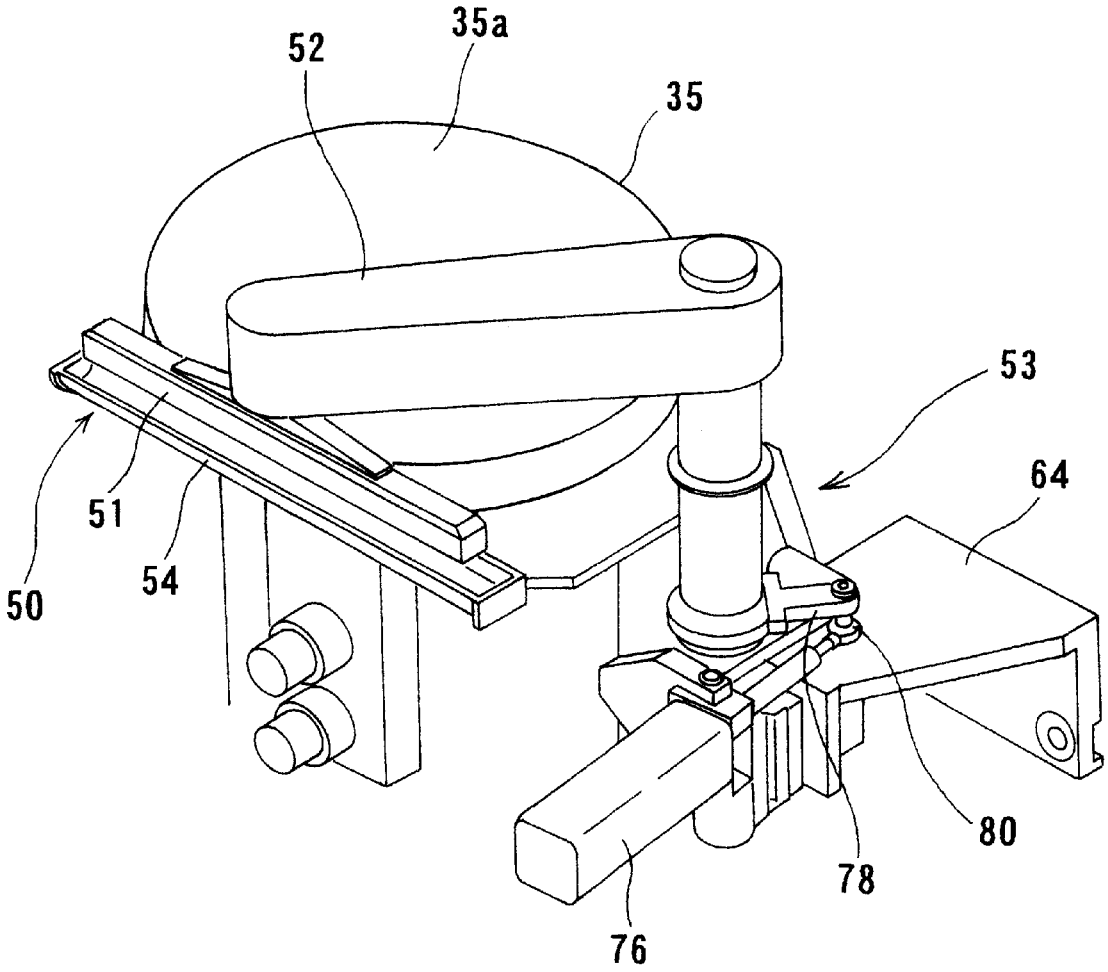
FIG. 3 is a perspective view showing a polishing table and a dressing apparatus according to an embodiment of the present invention.

FIG. 3 is a perspective view showing polishing table 35 and dressing apparatus 50. A flat polishing surface 35*a* as a polishing tool is formed on an upper surface of the polishing table 35. The dressing apparatus 50 is disposed adjacent to the polishing table 35. The dressing apparatus 50 comprises a dresser 51 for dressing the polishing surface 35*a* of the polishing table 35, a dresser arm 52 having a free end for supporting the dresser 51 thereon, and a dresser driving mechanism 53 for swinging the dresser arm 52 and vertically moving the dresser arm 52. The dressing apparatus 50 further comprises a dresser cleaning container 54 for cleaning the dresser 51 with a cleaning liquid stored in the dresser cleaning container 54.

Figure 4:
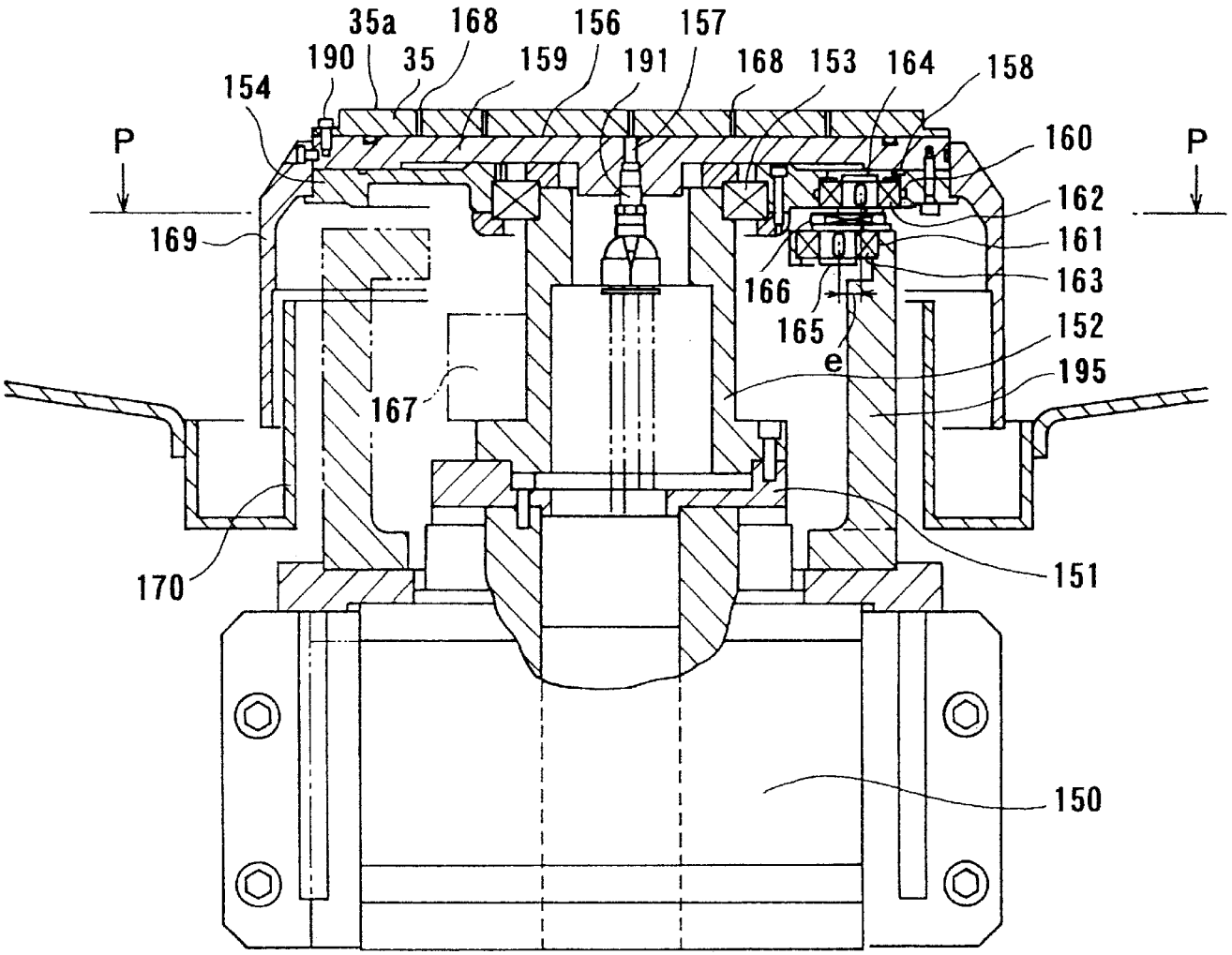
FIG. 4 is a vertical cross-sectional view of the polishing table shown in FIG. 3.
Figure 5A:
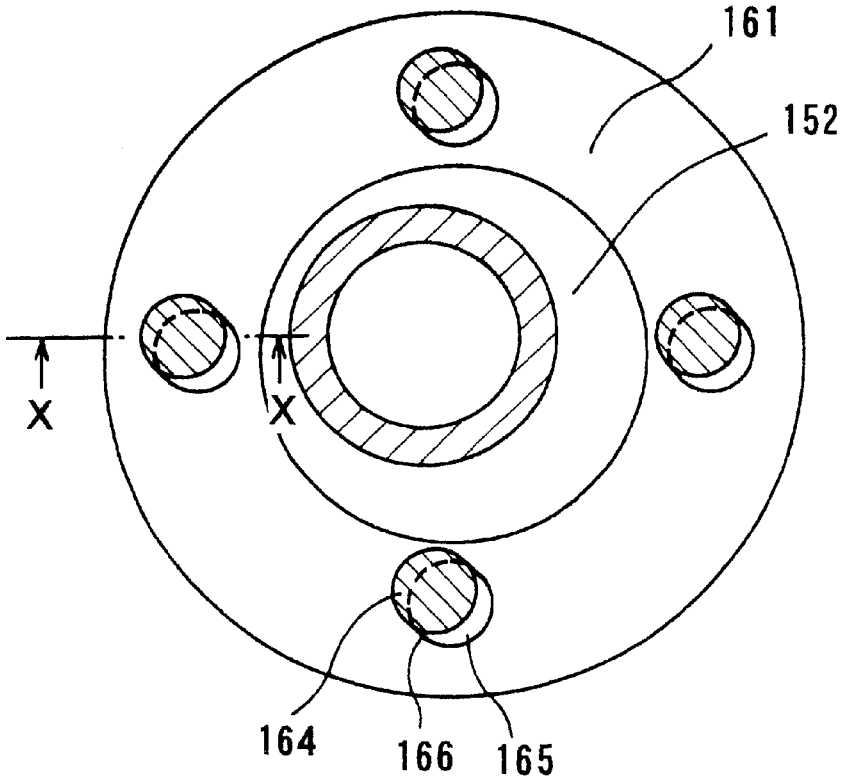
FIG. 5A is a cross-sectional view taken along line P—P of FIG. 4.
Figure 5B:
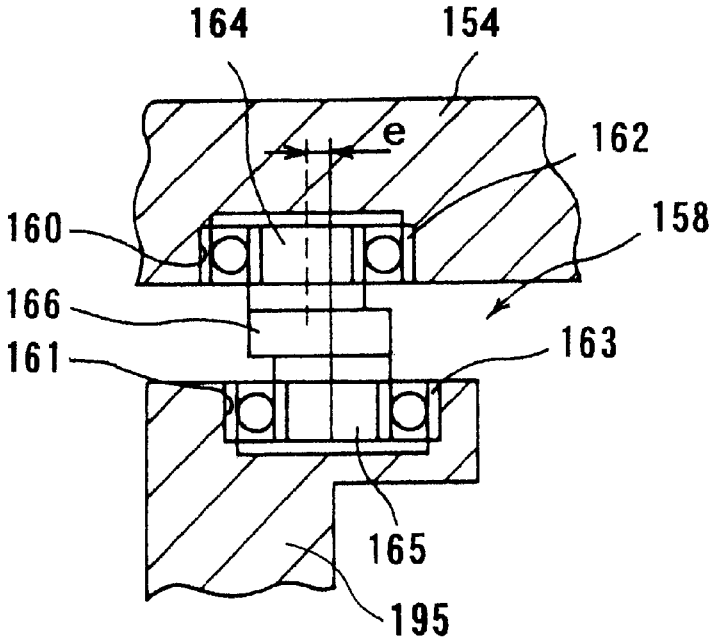
FIG. 5B is a cross-sectional view taken along line X—X of FIG. 5A.

FIGS. 4, 5A and 5B are views showing a detailed structure of polishing table 35. FIG. 4 is a vertical cross-sectional view of the polishing table. FIG. 5A is a cross-sectional view taken along line P—P of FIG. 4, and FIG. 5B is a cross-sectional view taken along line X—X of FIG. 5A.

As shown in FIGS. 4, 5A and 5B, the polishing table 35 has an upper flange 151 of a motor 150, and a hollow shaft 152 connected to the upper flange 151 by bolts. A set ring 154 is supported by an upper portion of the shaft 152 through a bearing 153. A table 159 is fixed to the set ring 154, and the polishing table 35 is fixed to the table 159 by bolts 190. The polishing table 35 may comprise a grinding stone (fixed abrasive) entirely, or may comprise a plate made of a corrosion) resistant metal, such as stainless steel, and a polishing cloth (polishing pad) attached to the plate. When using a grinding stone or polishing cloth, the polishing table 35 may have a flat upper surface or a slightly convex or concave upper surface. The shape of the upper surface of the polishing table 35 is selected depending on a kind of semiconductor wafer (substrate) W to be polished. An outer diameter of the polishing table 35 is set to a diameter that is at least equal to the diameter of a semiconductor wafer plus distance 2e (described below). That is, the diameter of the polishing table 35 is arranged such that when the polishing table 35 makes a translational motion, the semiconductor wafer W does not project from an outer periphery of the polishing table 35. The translational motion may be called scroll motion or orbital motion.

The set ring 154 has three or more supporting portions 158 in a circumferential direction, and the table 159 is supported by the supporting portions 158. A plurality of recesses 160, 161 are formed at positions corresponding to an upper surface of the supporting portions 158 of the set ring 154, and an upper end of a cylindrical member 195, at angularly equal intervals in a circumferential direction. Bearings 162 and 163 are mounted in the recesses 160 and 161. As shown in FIGS. 4, 5A and 5B, a support member 166 having two shafts 164 and 165, whose central axes are spaced by "e," is supported by the bearings 162 and 163. Specifically, the two shafts 164 and 165 are inserted into the bearings 162 and 163, respectively. Thus, the polishing table 35 makes a translational motion along a circle having a radius "e" via actuation of the motor 150.

Further, a center of the shaft 152 is off-set by "e" from a center of the motor 150. A balancer 167 is fixed to the shaft 152 for balancing a load caused by eccentricity. Supply of the polishing liquid onto the polishing table 35 is conducted through interiors of the motor 150 and the shaft 152, a through-hole 157 provided at a central portion of the table 159, and a coupling 191. Supplied polishing liquid is once stored in a space 156 defined between the polishing table 35 and the table 159, and then supplied to an upper surface of the polishing table 35 through a plurality of through-holes 168 formed in the polishing table 35. The number and position of the through-holes 168 can be selected depending on processes to be performed. In a case where a polishing cloth is attached to the polishing table 35, the polishing cloth has through-holes at positions corresponding to positions of the through-holes 168. In a case where the polishing table 35 is made of a grinding stone in its entirety, an upper surface of the polishing table 35 has grid-like, spiral, or radial grooves, and the through-holes 168 communicate with such grooves.

Supplied polishing liquid may be selected from pure water, chemicals, or slurry, and, if necessary, more than one kind of polishing liquid can be supplied simultaneously, alternatively, or sequentially. In order to protect a mechanism for performing a translational motion from polishing liquid during polishing, a flinger or a thrower 169 is attached to the table 159, and forms a labyrinth mechanism together with a trough 170.

In the polishing table having the above structure, the upper and lower bearings 162, 163 are axially interconnected by the support member 166 comprising a cranked joint having the upper and lower shafts 164, 165 that are fitted respectively in the upper and lower bearings 162, 163. The shafts 164, 165, and hence the upper and lower bearings 162, 163, have respective axes horizontally spaced from each other by a distance "e". The cylindrical member 195 for supporting the lower bearing 163 is fixed to a frame, and hence is stationary. When the motor 150 is energized, the shaft 152 is rotated by a radius of gyration (e) about a central axis of the motor 150, and thus the polishing table 35 makes a circulatory translational motion (scroll motion) through the cranked joint, and a semiconductor wafer W attached to the top ring 32 is pressed against a polishing surface 35*a* of the polishing table 35. The semiconductor wafer W is polished by polishing liquid supplied through the through-hole 157, the space 156 and the through-holes 168. The semiconductor wafer W is polished by relative circulatory translational motion, having a radius "e", between the polishing surface 35*a* of the polishing table 35 and the semiconductor wafer W, and the semiconductor wafer W is uniformly polished over an entire surface of the semiconductor wafer. If a surface, to be polished, of the semiconductor wafer W and the polishing surface 35*a* have the same positional relationship, then a polished semiconductor wafer is affected by a local difference in the polishing surface. In order to eliminate this influence, the top ring 32 is rotated at a low speed to prevent the semiconductor wafer from being polished at the same area on the polishing surface.

Figure 6:
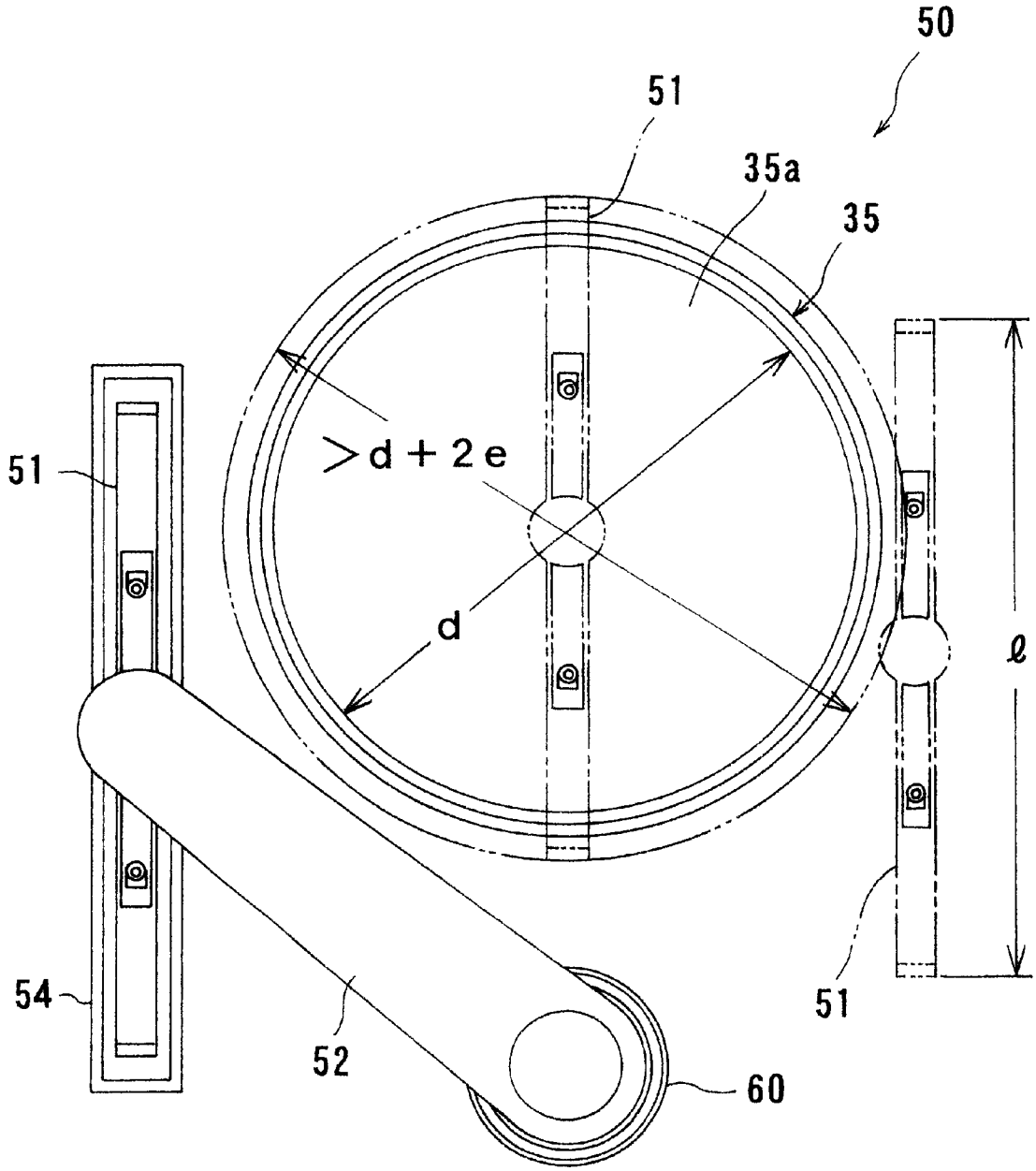
FIG. 6 is a plan view of the dressing apparatus shown in FIG. 3.

FIG. 6 is a plan view showing a detailed structure of each dressing apparatus 50. As shown in FIG. 6, the dresser 51 has an elongate shape, and a length l of the dresser 51 is set to be larger than a dimension (corresponding to movement area of the polishing surface) obtained by adding twice eccentricity "e" to a diameter d of polishing surface 35*a*, i.e., l>d+2e. A width of the dresser 51 is set to a dimension as small as dressing conditions permit. That is, when comparing the length l with diameter $d_2$ of a semiconductor wafer, $l>d_2+4e$. This allows space in a width direction to be saved greatly, compared with a circular dresser. Similarly, the dresser cleaning container 54 may be rectangular so as to correspond to a shape of the dresser 51, thus saving an installation space of the dresser cleaning container 54. Further, the polishing table does not rotate about its own axis but makes a scrolling motion, and therefore the dresser has a structure such that the dresser does not rotate about its own axis. Relative velocity between the polishing table and the dresser becomes equal at every point on the polishing surface by a scrolling motion of the polishing table and horizontal movement of the dresser at a constant velocity.

The dressing apparatus 50 shown in FIG. 6 comprises a cylinder for vertically moving the dresser 51, and a swing mechanism and a link mechanism for horizontally moving the dresser 51. Diamond particles capable of dressing or conditioning a polishing surface are uniformly attached to an entire surface of dressing surface 51*a* of the dresser 51 by electrode position or the like. The dressing surface may be composed of ceramics such as SiC (silicon carbide).

Figure 7:
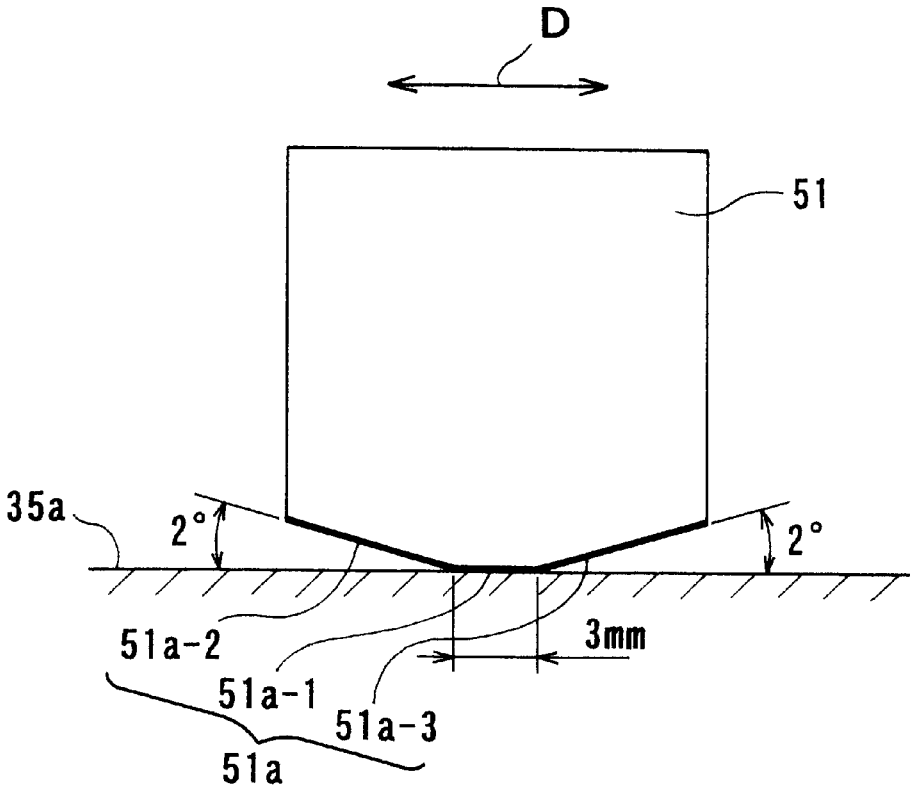
FIG. 7 is a schematic view showing a configuration of cross section of an elongate (bar-like) dresser.
Figure 8:
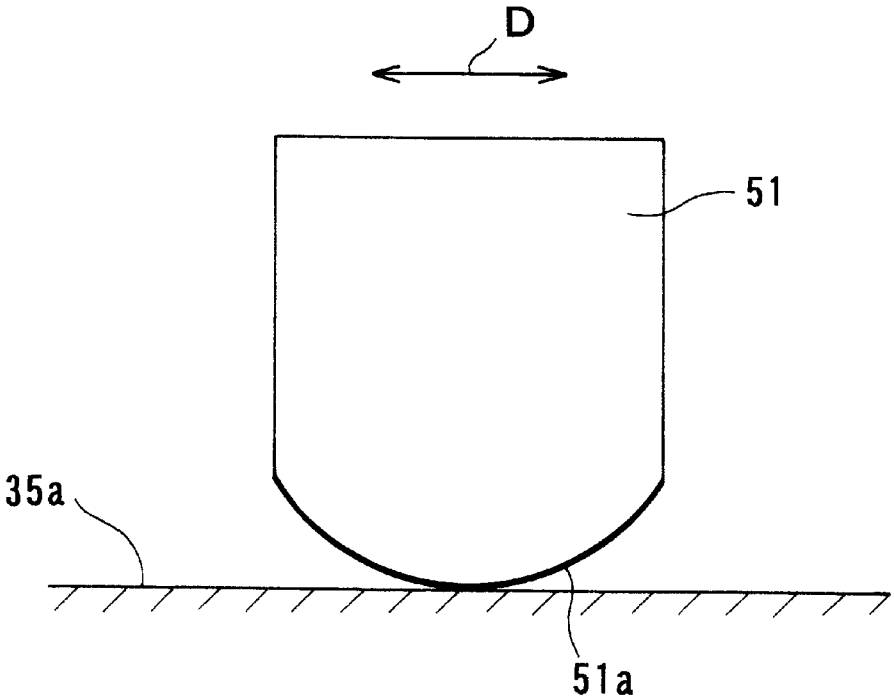
FIG. 8 is a schematic view showing a configuration of cross section of an elongate (bar-like) dresser.

FIGS. 7 and 8 are views showing a configuration of a cross section of an elongate (bar-like) dresser. Dresser 51 shown in FIG. 7 has a substantially rectangular cross section, and a dressing surface 51*a* comprises a flat portion (flat surface) 51*a*-1, and right and left tapered portions (tapered surfaces) 51*a*-2, 51*a*-3 disposed at both ends of the flat portion 51*a*-1 and inclined upwardly so as to be directed away from polishing surface 35*a* toward direction D of movement of the dresser 51. A width of the flat portion 51*a*-1 is set to 2 to 5 mm, preferably 3 mm. An angle of inclination of the right and left tapered portions 51*a*-2, 51*a*-3 is set to 1° to 5°, preferably 2°. The flat portion 51*a*-1, and the tapered portions 51*a*-2, 51*a*-3 comprise electrodeposited diamond surfaces which are formed by electrodepositing diamond particles as shown by bold solid lines. In place of the right and left tapered portions 51*a*-2, 51*a*-3, these portions may comprise curved surfaces extending from the flat portion 51*a*-1 so as to be directed away from the polishing surface 35*a*.

According to the dresser 51 shown in FIG. 7, a contact area between the dressing surface 51*a* of the dresser 51 and the polishing surface 35*a* of the polishing table 35 is reduced, and hence a frictional force between the dressing surface and the polishing surface during dressing can be reduced. Thus, vibration of the dresser generated when the dresser 51 reciprocates can be suppressed. Further, since the tapered portions (tapered surfaces) 51*a*-2, 51*a*-3 are inclined upwardly toward the direction of movement of the dresser 51, edges are not formed at boundary portions between the flat portion (flat surface) 51*a*-1 and the tapered portions 51*a*-2, 51*a*-3, and such boundary portions become smooth. Therefore, a stick-slip caused between the dressing surface and the polishing surface can be decreased, and the dresser 51 can be smoothly moved.

Dresser 51 shown in FIG. 8 has a substantially rectangular cross section, and dressing surface 51*a* comprises a circular arc surface. An entire surface of the dressing surface 51*a* comprises an electrodeposited diamond surface. In the dresser shown in FIG. 8, a contact area between the dressing surface 51*a* of the dresser 51 and polishing surface 35*a* of polishing table 35 can be reduced, as with the dresser shown in FIG. 7. Thus, generation of vibration of the dresser can be suppressed, and the dresser can move smoothly because the dressing surface 51*a* comprises a smooth circular arc surface.

Next, a mechanism for vertically moving the dresser 51, and horizontally moving the dresser 51 in the dressing apparatus 50, will be described with reference to FIGS. 9 through 11.

Figure 9:
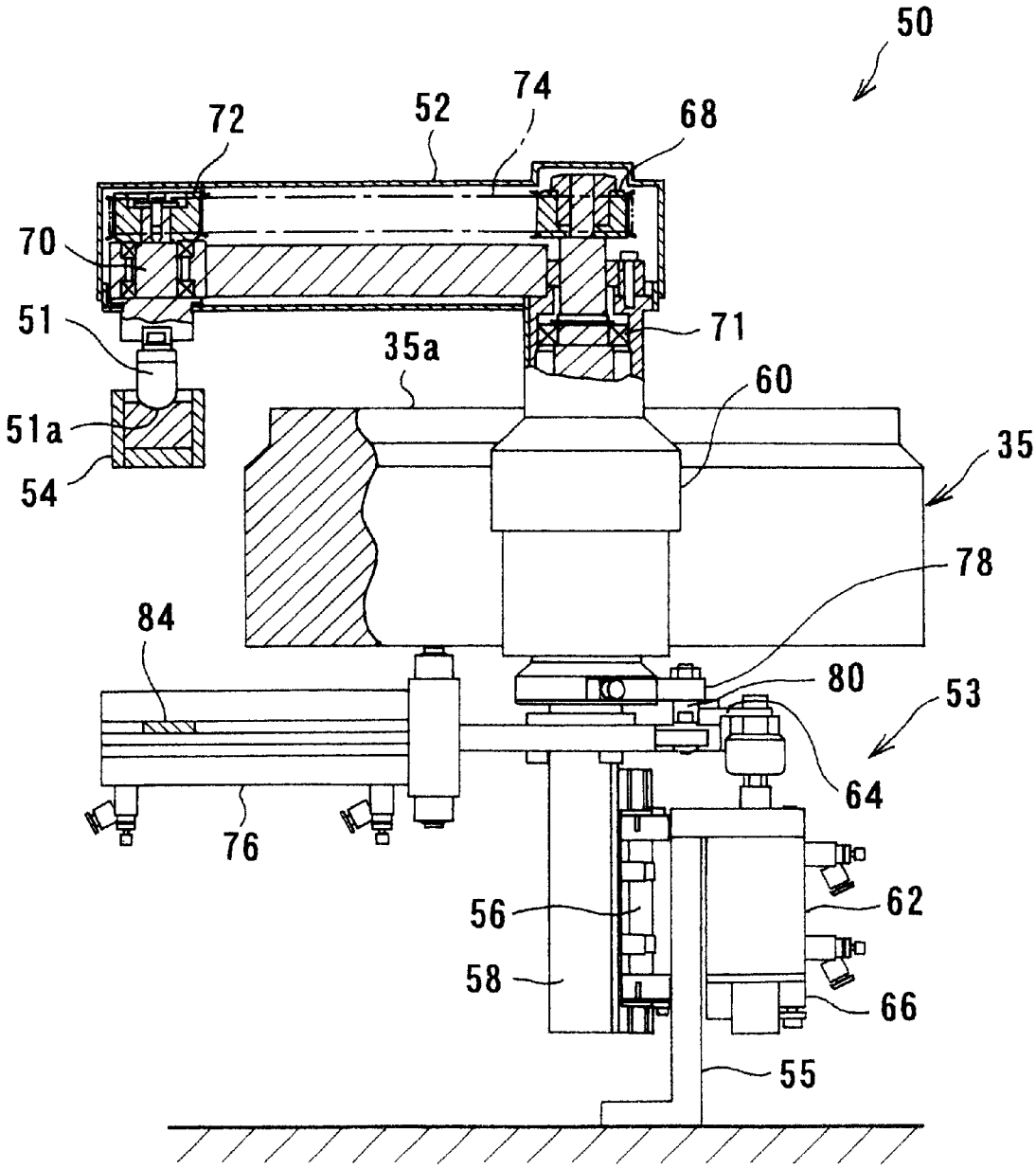
FIG. 9 is a front view with a partially cross-sectioned part of the dressing apparatus shown in FIG. 6.
Figure 10:
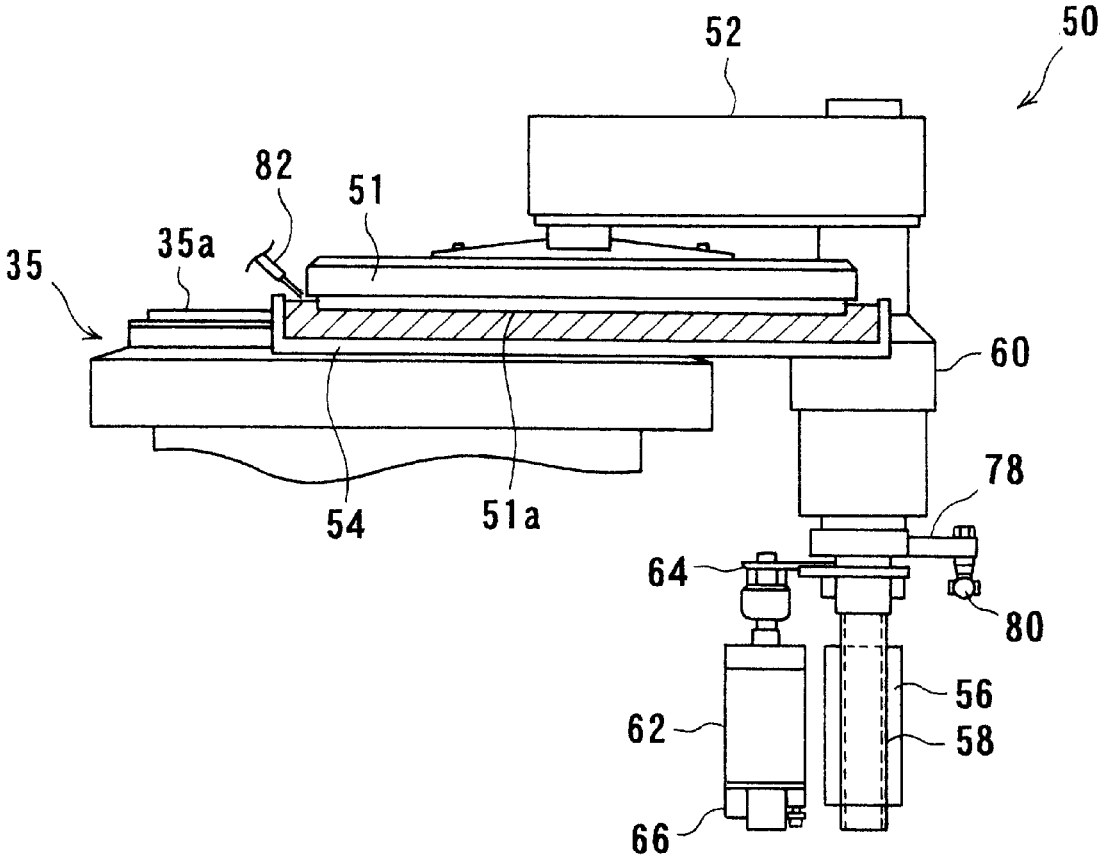
FIG. 10 is a left side view with a partially cross-sectioned part of the dressing apparatus shown in FIG. 6.
Figure 11:
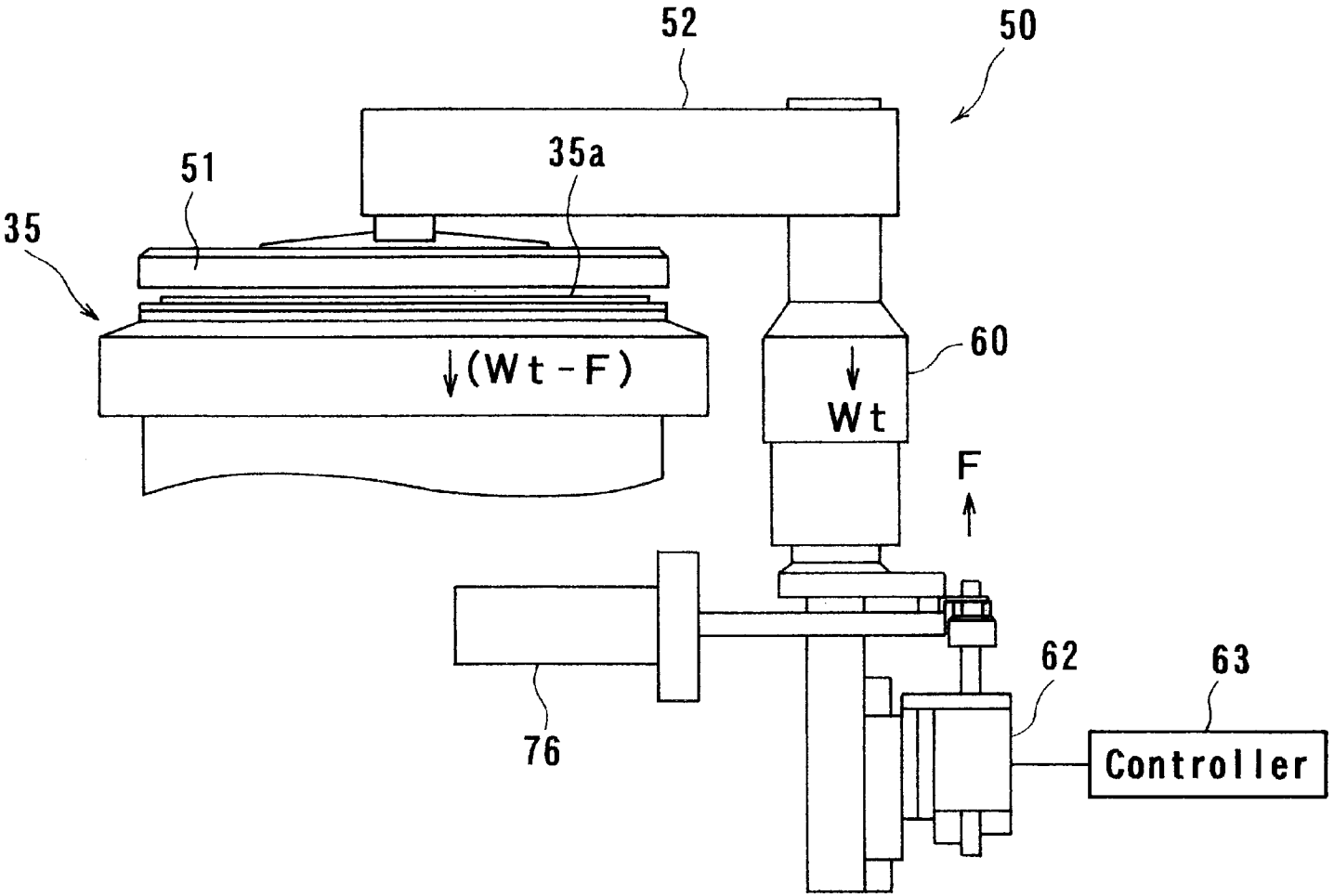
FIG. 11 is a schematic view showing a manner by which a pressing force of a dresser is controlled in the dressing apparatus.

As shown in FIGS. 9 through 11, dressing apparatus 50 comprises a vertical shaft 58 which moves vertically and is guided by a linear guide 56 fixed to a base 55, a swing shaft 60 having a follow structure and enclosing the vertical shaft 58, and a dresser arm 52 coupled to the swing shaft 60. The dresser arm 52 has a free end which supports dresser 51. A lifting/lowering cylinder 62 is fixed to the base 55, and has a piston rod whose upper end is coupled to a lifting/lowering base 64 which is fixed to the vertical shaft 58.

The vertical shaft 58 has an upper end to which a drive pulley 68 is mounted, and a belt 74 is provided between the drive pulley 68 and a driven pulley 72 mounted on a dresser support shaft 70 which is rotatably provided at a free end of the dresser arm 52. A bearing 71 is interposed between the vertical shaft 58 and the swing shaft 60. Further, the dresser support shaft 70 extends downwardly, and has a lower end to which the dresser 51 is attached.

A swing cylinder 76 is fixed to the lifting/lowering base 64, and a piston rod of the swing cylinder 76 is connected through a ball joint 80 to a forward end of a link arm 78 projecting in a direction perpendicular to an axis of the swing shaft 60. Thus, when the lifting/lowering cylinder 62 is actuated, the swing cylinder 76 is vertically moved integrally with the lifting/lowering base 64, and when the swing cylinder 76 is actuated, the swing shaft 60 is rotated to allow the dresser arm 52 to be swung. When the dresser arm 52 is swung, the dresser 51 moves horizontally to perform a translation at a constant speed in one direction by a translation mechanism comprising the pulleys 68, 72 and the belt 74.

In this embodiment, dresser cleaning container 54 serves to prevent dressing surface 51*a* of the dresser 51 from drying. As shown in FIG. 10, a tube 82 is attached to the dresser cleaning container 54 for supplying a cleaning liquid to the dresser cleaning container 54, and the cleaning liquid is always supplied to the dresser cleaning container 54 to keep clean cleaning liquid in the dresser cleaning container 54. The dresser 51 is located at a lowered position in a standby condition, and the dressing surface 51*a* is immersed in the cleaning liquid in the dresser cleaning container 54 to prevent the dressing surface 51*a* from drying.

Next, a series of operations in which the dresser 51 is removed from the dresser cleaning container 54, and dresses the polishing surface 35*a* of the polishing table 35, and then returned to the dresser cleaning container 54 will be described.

The dresser 51 is located at a lowered position in the dresser cleaning container 54. By actuating the lifting/lowering cylinder 62, the dresser 51 is lifted and removed from the dresser cleaning container 54. A position to which the dresser 51 is lifted is determined by stopper 66. In this state, the swing cylinder 76 is actuated, and the swing shaft 60 is rotated to swing the dresser arm 52 toward the polishing surface 35*a* of the polishing table 35. Then, since the drive pulley 68, the driven pulley 72 and the belt 74 jointly constitute a link mechanism for performing a translation of the dresser 51, even if the dresser arm 52 is swung by rotation of the swing shaft 60, the dresser 51 does not change its direction but performs a translation. Therefore, the dresser 51 is transferred onto the polishing surface 35*a* of the polishing table 35, and then the dressing surface 51*a* is pressed against the polishing surface 35*a* to dress the polishing surface 35*a* by the dressing surface 51*a*. A center of the dresser 51 passes through a center of the polishing surface 35*a*, and the length l of the dresser 51 is larger than a diameter of a circle which is described by an outer periphery of the polishing surface 35*a*, which makes a scrolling motion. Thus, the dresser 51 can dress an entire area of the polishing surface 35*a*.

The dresser 51 moves along the polishing surface 35*a* while dressing the polishing surface 35*a*, which makes a scrolling motion, and reaches an end of the polishing surface 35*a* at its stroke end and stops. Thereafter, the dresser 51 moves in an opposite direction by switching an operational direction of the link mechanism while dressing the polishing surface 35*a*. As shown in FIG. 9, a sensor 84 for detecting a stroke end of the swing cylinder 76 is attached to the swing cylinder 76 to determine timing of switching the operational direction of the link mechanism and monitor operation.

Dressing is repeated a predetermined number of times, and then the dresser is returned to the dresser cleaning container 54 and a dressing operation is terminated.

In the dressing apparatus 50 of the present invention, a device for controlling a pressing force for pressing the dressing surface 51*a* of the dresser 51 against the polishing surface 35*a* is used. Specifically, as shown in FIG. 11, the lifting/lowering cylinder 62 is used as a lifting/lowering mechanism of the dresser 51, and air pressure supplied to the lifting/lowering cylinder 62 is controlled by a controller 63, such as an electropneumatic regulator, so that a difference (Wt−F) between a weight Wt of the dresser 51 and a thrust F of the lifting/lowering cylinder 62 becomes a target pressing force for pressing the dresser 51 against the polishing surface 35*a*.

Figure 12A:
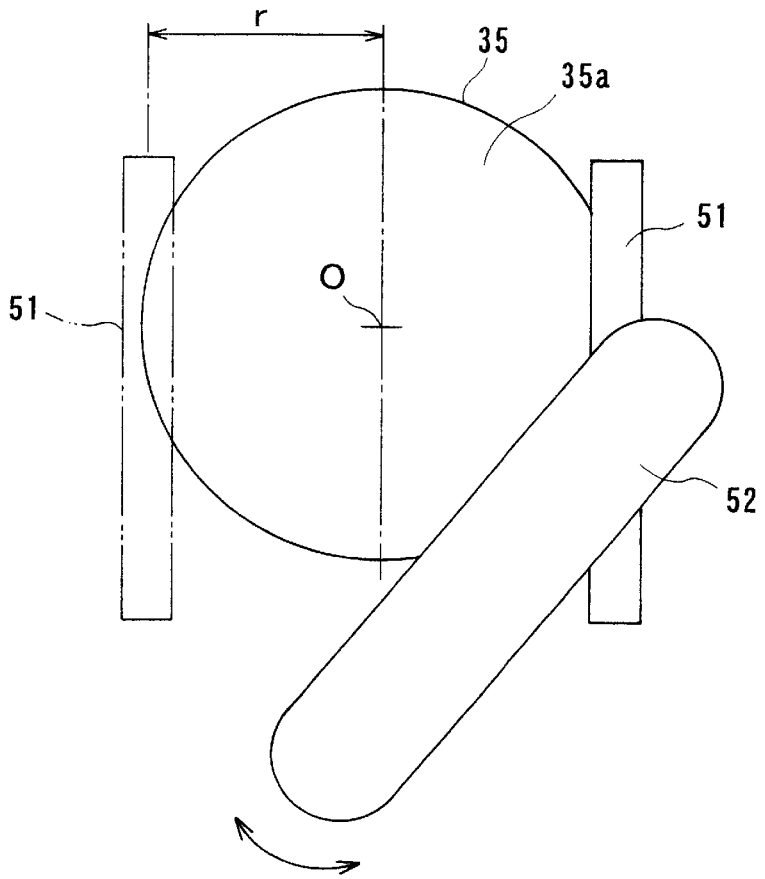
FIG. 12A is a schematic view showing a manner by which a pressing force for pressing a dressing surface against a polishing surface is controlled using the manner for controlling the pressing force of the dresser shown in FIG. 11, and specifically showing a relationship between the polishing table and the dresser.
Figure 12B:
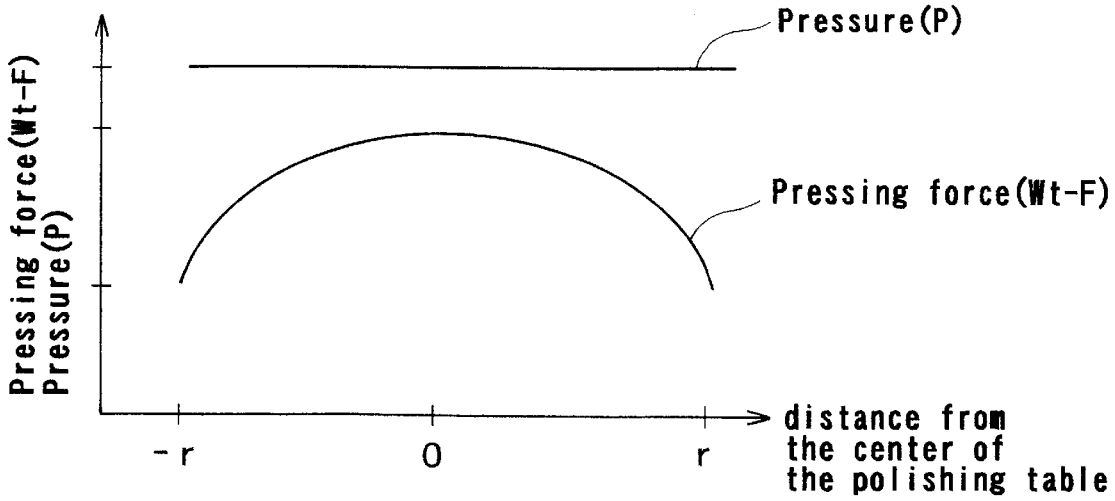
FIG. 12B is a graph showing a relationship between a distance from a center of the polishing table, and a pressing force and a pressure of the dresser shown in FIG. 12A.

FIGS. 12A and 12B are views showing a method for controlling a pressing force for pressing the dressing surface 51*a* against the polishing surface by using the method for controlling the pressing force of the dresser shown in FIG. 11. FIG. 12A is a schematic view showing a relationship between the polishing table and the dresser, and FIG. 12B is a graph showing a relationship between a distance from a center of the polishing table, and a pressing force and a pressure of the dresser.

As shown in FIG. 12A, as the dresser 51 moves radially outwardly from a center O of the polishing table 35, a contact area between the dressing surface 51*a* of the dresser 51 and the polishing surface 35*a* of the polishing table 35 decreases. Therefore, if a pressing force (a pressing force applied to the entire dressing surface) of the dresser 51 is constant, a pressing force (a pressure applied to the polishing surface per unit area) is not constant; thus suffering a change of an amount of a material removed from the polishing surface.

Therefore, in the present embodiment, as shown in FIG. 12B, as the dresser 51 moves radially outwardly from the center O of the polishing table 35, the pressing force (Wt−F: a pressing force applied to the entire dressing surface) of the dresser 51 is controlled so as to be made smaller by the controller 63. Thus, irrespective of a position of the dresser, pressing force P (a pressure applied to the polishing surface per unit area) is controlled so as to be constant, and hence an amount of material removed from the polishing surface becomes constant. In this case, if horizontal movement of the dresser 51 is performed by a pulse motor, a position of the dresser 51 is determined by the number of pulses in the pulse motor, and if pressure of the lifting/lowering cylinder 62 is controlled, according to the position of the dresser 51, by the controller 63, then the pressing force (Wt−F) of the dresser 51 can be controlled according to the position of the dresser 51. The lifting/lowering cylinder 62 may be replaced with an electric actuator such as a linear stepping motor, and the controller 63 may be an electric circuit.

Figure 13:
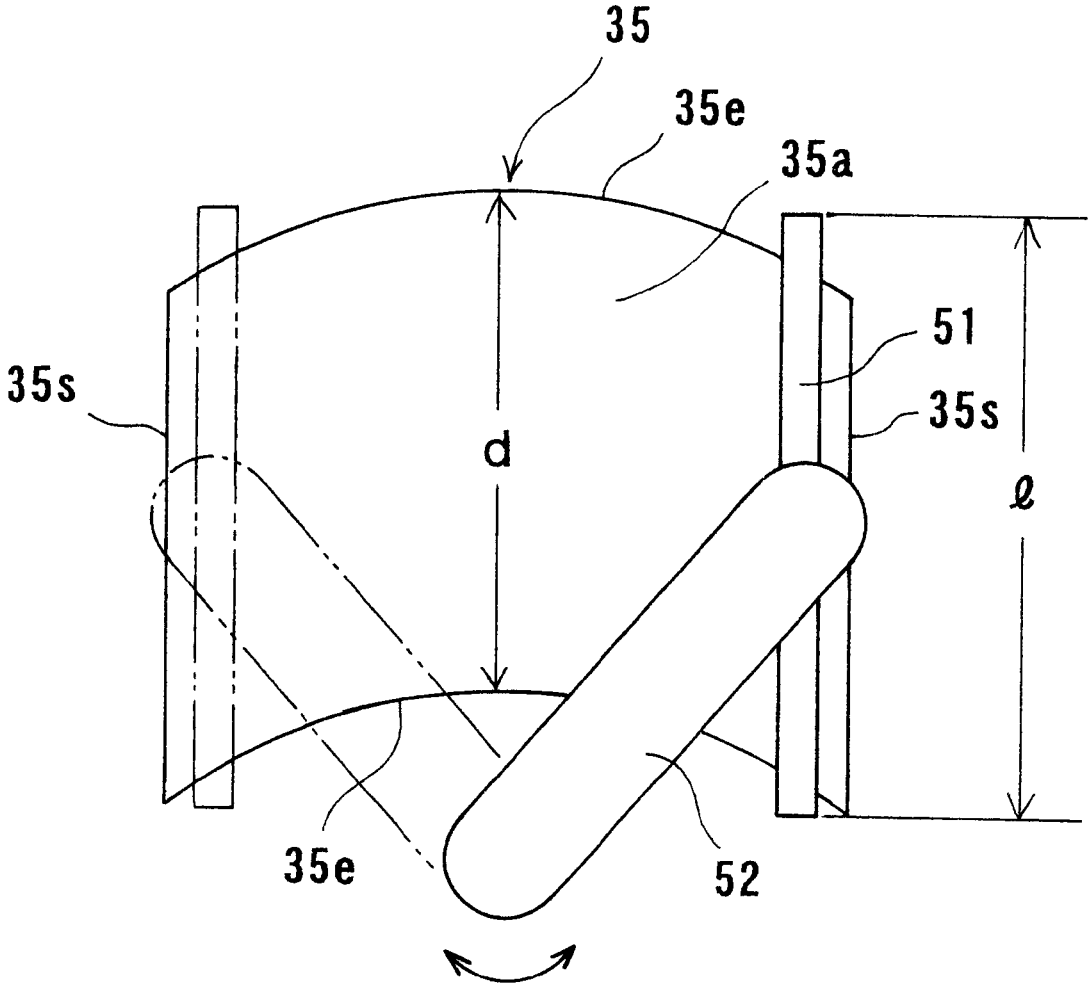
FIG. 13 is a plan view of a polishing table according to another embodiment of the present invention.

FIG. 13 is a plan view of a polishing table according to another embodiment of the present invention. In the embodiment shown in FIG. 13, polishing table 35 is generally rectangular. Specifically, both side ends 35*s*, 35*s* of the polishing table 35 are linear and parallel to each other, and upper and lower ends 35*e*, 35*e* are arcuate and parallel to each other. Length l of dresser 51 is longer than length d of the polishing table 35. The upper and lower ends 35*e*, 35*e* of the polishing table 35 are located inwardly of circular arc loci described by upper and lower ends of the dresser 51. Both side ends 35*s*, 35*s* of the polishing table 35 are located outwardly of a moving area of the dresser 51. That is, the dresser 51 performs a dressing operation within both ends of the polishing table 35, which makes a scrolling motion, so that the dresser 51 does not fall from the polishing table 35. In the embodiment shown in FIG. 12A, the polishing table is circular, and hence a pressing force of the dresser is changed according to a position of the dresser. However, in the embodiment shown in FIG. 13, a contact area between a dressing surface of the dresser 51 and polishing surface 35*a* of the polishing table 35 is always constant irrespective of a position of the dresser, and hence a pressing force of the dresser is not changed and is always constant.

Next, a linear polishing apparatus having a dressing apparatus according to the present invention will be described below with reference to FIGS. 14A, 14B and 15.

Figure 14A:
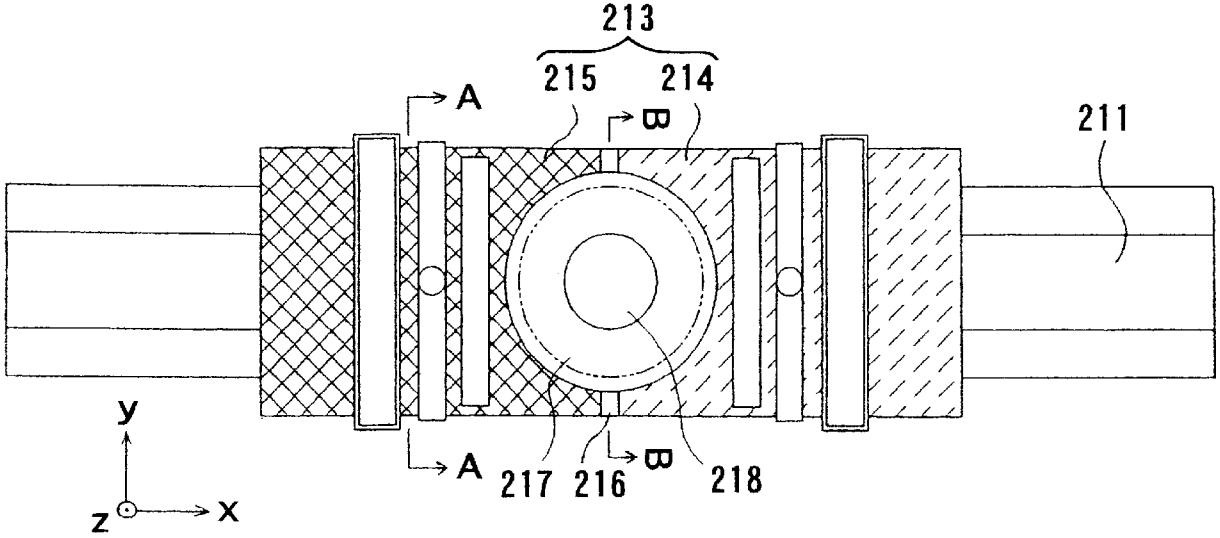
FIG. 14A is a plan view of a linear polishing apparatus according to another embodiment of the present invention.
Figure 14B:
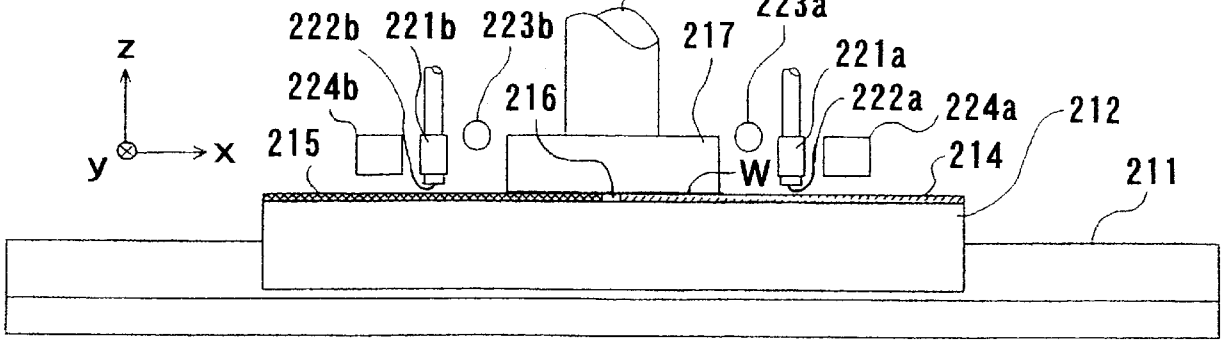
FIG. 14B is a front view of the linear polishing apparatus according to another embodiment of the present invention.
Figure 15:
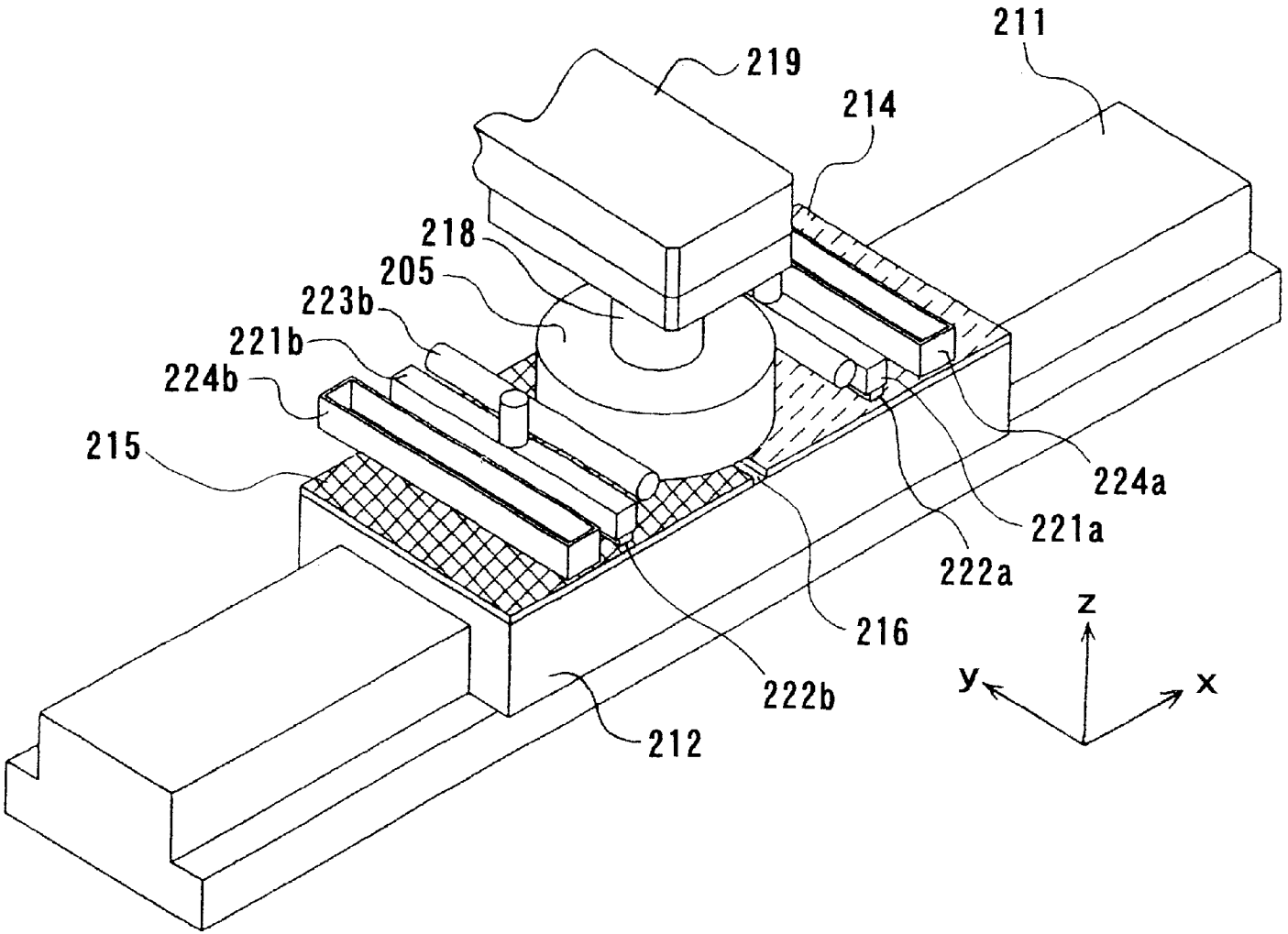
FIG. 15 is a perspective view of the linear polishing apparatus shown in FIGS. 14A and 14B.

FIGS. 14A and 14B are views of a linear polishing apparatus, wherein FIG. 14A is a plan view of the linear polishing apparatus and FIG. 14B is a front view of the linear polishing apparatus. FIG. 15 is a perspective view of the linear polishing apparatus shown in FIGS. 14A and 14B. In the linear polishing apparatus, a polishing table 212 which reciprocates linearly in a horizontal direction is placed on a guide surface of a guide rail 211 serving as a linear guide whose guide surface is disposed horizontally.

Here, x, y, and z are rectangular coordinates defining a position of a point in space. In this case, x-axis is in a direction of a reciprocating linear motion along the guide rail 211, y-axis is in a direction perpendicular to the x-axis and is in a horizontal plane, and z-axis is in a vertical direction. A first direction of the present invention corresponds to a direction of the x-axis.

An upper surface of the polishing table 212 constitutes a polishing surface 213 contained in a horizontal plane. The polishing surface 213 is divided into a rough polishing surface 214 for rough polishing, and a fine polishing surface 215 for finish polishing. Between the rough polishing surface 214 and the fine polishing surface 215, there is provided a multifunction groove 216 formed linearly in a direction (y-axis direction) perpendicular to the direction of linear motion (x-axis direction) along the guide rail 211. In the following description, if it is not necessary to distinguish between the rough polishing surface 214 and the fine polishing surface 215, the polishing surface is simply referred to as the polishing surface 213.

In this embodiment, although the polishing surface includes two kinds of polishing surfaces 214 and 215, the polishing surface may include three or more kinds of polishing surfaces depending on a process to be performed. For example, in addition to the rough polishing surface and the fine polishing surface, there may be provided a reforming surface for reforming a surface of a substrate for a purpose of improving a cleaning effect of the substrate. A thick disk-like top ring 217 for holding a substrate W, such as a semiconductor wafer, to be polished and pressing the substrate W against the polishing surface 213 is provided above the polishing surface 213. The top ring 217 is connected at an opposite side of a holding surface of the substrate W to a pressing mechanism 218 for rotating the top ring 217 about a vertical axis and pressing the top ring 217. The pressing mechanism 218 serves to move the top ring 217 in a horizontal direction perpendicular to a moving direction of the polishing table 212, and also to press the top ring 217 against the polishing surface 213. The pressing mechanism 218 is adapted to be moved by an arm 219 (see FIG. 15).

Further, two elongate rectangular dressers 221*a*, 221*b* for dressing the polishing surface 213 are disposed adjacent to the top ring 217 in the x-axis direction. The two dressers 221*a*, 221*b* are located at positions which are symmetrical with respect to the top ring 217. The dressers 221*a*, 221*b* have respective dressing surfaces 222*a*, 222*b* which confront the polishing surface 213. The dressers 221*a*, 221*b* are elongate and have a rectangular cross section, and the dressing surfaces 222*a*, 222*b* are rectangular. A longitudinal direction of each of the rectangular dressing surfaces 222*a*, 222*b* corresponds to the y-axis direction. Further, nozzles 223*a*, 223*b* for supplying liquid to the dressers 221*a*, 221*b*, respectively, are provided between the top ring 217 and the dressers 221*a*, 221*b*, respectively. Further, rectangular dresser cleaning containers 224*a*, 224*b* are disposed at respective opposite sides of the nozzles 223*a*, 223*b* in the x-axis direction with respect to the dressers 221*a*, 221*b*, respectively, and a longitudinal direction of each of the rectangular dresser cleaning containers 224*a*, 224*b* corresponds to the y-axis direction. In the following description, in a case where a plurality of identical elements, for example, two identical elements such as the dressers 221*a*, 221*b* are not necessary to be distinguished from each other, suffix a, b are omitted, and the dressers are simply referred to as, for example, dresser 221.

Next, operation of the linear polishing apparatus having the above structure will be described with reference to FIGS. 14A, 14B and 15.

When a polishing process is started, substrate W held by the top ring 217 under vacuum with a surface, to be polished, of the substrate W facing downwardly is pressed against the polishing surfaces 214, 215 which reciprocate linearly in the x-axis direction.

The top ring 217 reciprocates linearly in the direction (y-axis direction, a third direction of the present invention) perpendicular to the direction (x-axis direction) of the reciprocating linear motion of the polishing surfaces 214, 215. In order to prevent a polished surface of the substrate from being scratched locally, the top ring 217 is rotated at a low rotational speed such as about 10 revolutions/minute. Because rotational speed of the top ring 217 is low, the surface, to be polished, of the substrate W substantially makes a linear motion with respect to the polishing surface 213. In other words, the top ring 217 is rotated at such a low speed as to allow the surface, to be polished, of the substrate to make a linear motion substantially with respect to the polishing surface 213.

In general, the surface, to be polished, of the substrate, which is stationary and is pressed against the polishing surface 213 which makes a reciprocating linear motion, has the same moving speed with respect to the polishing surface at every point on an entire surface of the substrate, and hence uniform polishing can be performed theoretically over the entire surface of the substrate. Further, in this embodiment, by rotating the substrate at a very low speed, uniform polishing of the surface of the substrate can be performed, and a polished surface of the substrate can be prevented from being scratched or damaged locally.

A plurality of holes (not shown) for discharging a polishing liquid are formed in the polishing surfaces 214, 215 to supply the polishing liquid therethrough directly between the polishing surfaces 214, 215 and the substrate W. Because the polishing liquid is supplied in this manner, although slurry such as a polishing liquid is difficult to be supplied during a reciprocating linear motion differently from a rotating motion, the polishing liquid can be uniformly supplied over an entire surface, to be polished, of the substrate.

First, in order to perform a rough polishing of the substrate W by the polishing surface 214, the polishing table 212 makes a reciprocating linear motion in the x-axis direction to polish the substrate W only by the polishing surface 214. Similarly, in case of finish-polishing of the substrate by the polishing surface 215, the polishing table 212 makes a reciprocating linear motion in the x-axis direction within an area of the polishing surface 215. In this manner, polishing of different roughness can be performed on the same polishing table 212.

The polishing surfaces 214, 215 may comprise an elastic pad such as a polishing cloth. Because the polishing table 212 has a structure such that the polishing table 212 makes a reciprocating linear motion, at least one of the polishing surfaces 214, 215 may comprise a fixed abrasive (abrading plate). If fixed abrasive is used, formation of dishing in a polished surface of the substrate can be prevented. Since the polishing table 212 makes a reciprocating linear motion, the upper surface of the polishing table 212 is normally a rectangular surface having a certain area different from that of an endless belt; thus facilitating replacement of the elastic pad or the fixed abrasive.

To be more specific, in the polishing apparatus in which a polishing surface is formed by attaching a polishing pad, a polishing liquid is supplied between a substrate and the polishing pad. However, since the polishing pad is an elastic body, even if a substrate is polished by applying a pressure uniformly over an entire surface of the substrate, for a substrate whose surface to be polished has irregularities, not only raised regions but also depressed regions are polished. Therefore, when polishing of the raised regions is completed, polishing of the depressed regions inevitably progress, and depressed regions formed after polishing are called "dishing". In order to increase a polishing rate, it is conceivable to increase a pressing force for pressing a substrate against a polishing surface. However, if a polishing pad is used as a polishing surface, then the above-mentioned problem arises remarkably, and hence it is difficult to cope with both high polishing rate and high planarization.

However, as in the embodiment of the present invention, if a fixed abrasive (abrading plate) is used, both high polishing rate and prevention of formation of dishing are compatible. Specifically, the fixed abrasive (abrading plate) is suitable for the polishing surface 214 for rough polishing. In either case of the polishing surface 214 for rough polishing and the polishing surface 215 for finish polishing, it is suitable to provide a groove so as to extend fully across the polishing surface. The groove preferably extends at a right angle to the moving direction (x-axis direction) of the polishing surface, or extends obliquely for promoting a discharge of used polishing liquid or the like, or preventing peeling of the polishing pad.

Further, in order to perform polishing of a workpiece (substrate) at high efficiency, there are some cases where two kinds of polishing, i.e. rough polishing and finish polishing are required in one stroke. Conventionally, because polishing surfaces for rough polishing and finish polishing are separately provided at different positions, a necessity of various kinds of polishing surfaces leads to an increase of an installation area of polishing apparatus. However, in the current embodiment of the present invention, a plurality of polishing surfaces including a polishing surface 214 for rough polishing and a polishing surface 215 for finish polishing, for example, are prepared as a polishing surface 213, and hence it is possible to provide a polishing apparatus which can polish workpieces at high efficiency, without increasing an installation area of the apparatus.

Thus, the polishing table 212 is provided with a fixed abrasive and a polishing cloth selectively, and a workpiece can be polished under a condition suitable for a shape or property of a surface, to be polished, of the workpiece (substrate); thus improving polishing precision of the workpiece. Further, by providing two or more polishing surfaces, having the same properties or different properties, on a single polishing table, a processing capability per unit installation area can be increased, and degree of freedom for constructing a polishing process can be increased.

Next, a dressing process for dressing the polishing surfaces 214, 215, removing foreign materials from the polishing surfaces 214, 215 and regenerating the polishing surfaces 214, 215 will be described below. The dressing surfaces 222*a*, 222*b* of the dressers 221*a*, 221*b* are pressed against the polishing surfaces 214, 215, which make a reciprocating linear motion in the x-axis direction. The dressing surfaces 222*a*, 222*b* comprise an electrodeposited diamond surface. These dressing surfaces have the same structure as those shown in FIGS. 7 and 8.

The dressers 221*a*, 221*b* reciprocate linearly in the direction (y-axis direction, a second direction of the present invention) perpendicular to the moving direction of the polishing surfaces 214, 215 (x-axis direction). In this manner, by providing the dressers 221*a*, 221*b* which move in the direction perpendicular to the polishing surfaces 214, 215, which reciprocate linearly, polishing surfaces 214, 215 in their entirety can be uniformly dressed. When dressing of the polishing surfaces 214, 215 is carried out, a dressing liquid is discharged from the nozzles 223*a*, 223*b* provided in the vicinity of the dressers 221*a*, 221*b* to discharge foreign materials on the polishing surfaces 214, 215 to an exterior of the polishing surfaces 214, 215. By providing the dressers 221*a*, 221*b* on both sides of the top ring 217, a distance of reciprocating linear motion of the dressers 221*a*, 221*b* in the x-axis direction during dressing can be shortened, and the dressing apparatus can be downsized. The dressers 221*a*, 221*b* preferably have such a size that a length of the dressing surfaces 222*a*, 222*b* in a longitudinal direction is longer than a width of the polishing table 212. With this structure, uniformity of dressing can be improved.

If foreign materials are accumulated at positions near the top ring 217, such foreign materials have a bad influence on polishing performance. Therefore, for example, during a latter half of a dressing process, when ends of the polishing table 212 are moving away from the dressers 221*a*, 221*b*, the dressers 221*a*, 221*b* are moving so as to be out of contact with the polishing surfaces 214, 215. Conversely, when ends of the polishing table 212 are moving toward the dressers 221*a*, 221*b*, the dressers 221*a*, 221*b* are brought into contact with the polishing surfaces 214, 215 to sweep foreign materials or the like from the polishing table 212 in a direction opposite to the multifunction groove 216. In this case, the polishing table 212 moves up to a position where the dressers 221*a*, 221*b* are out of contact with the polishing table 212, thereby completely sweeping foreign materials or the like from the polishing table 212. Further, foreign materials or the like collected by the dressers 221*a*, 221*b* may be discharged by using a discharge function of the multifunction groove 216.

In a case where dressing is not carried out, the dressers 221*a*, 221*b* are on standby at positions not in contact with the polishing surfaces 214, 215 by using a lifting/lowering mechanism, and discharge positions of the nozzles 223*a*, 223*b* are determined so that the dressing surfaces 222*a*, 222*b* can be rinsed at these positions by liquid supplied from the nozzles 223*a*, 223*b*.

In the above embodiment, the dressers 221*a*, 221*b* are disposed such that the longitudinal direction of each of the dressers 221*a*, 221*b* corresponds to the y-axis direction, and the direction of reciprocating linear motion of the dressers 221*a*, 221*b* corresponds to the y-axis direction as a second direction. However, arrangement of the dressers 221*a*, 221*b* is not limited to the above arrangement, and it may be sufficient to allow the direction of reciprocating linear motion of the dressers 221*a*, 221*b* to be in the x-axis direction. The second direction is preferably the same direction as that of the multifunction groove 216. Similarly, as a third direction, the direction of reciprocating linear motion of top ring 217 corresponds to the y-axis direction. However, the direction of reciprocating linear motion of the top ring 217 is not limited to this direction, and it may be sufficient to allow such direction to be in the x-axis direction.

Figure 16A:
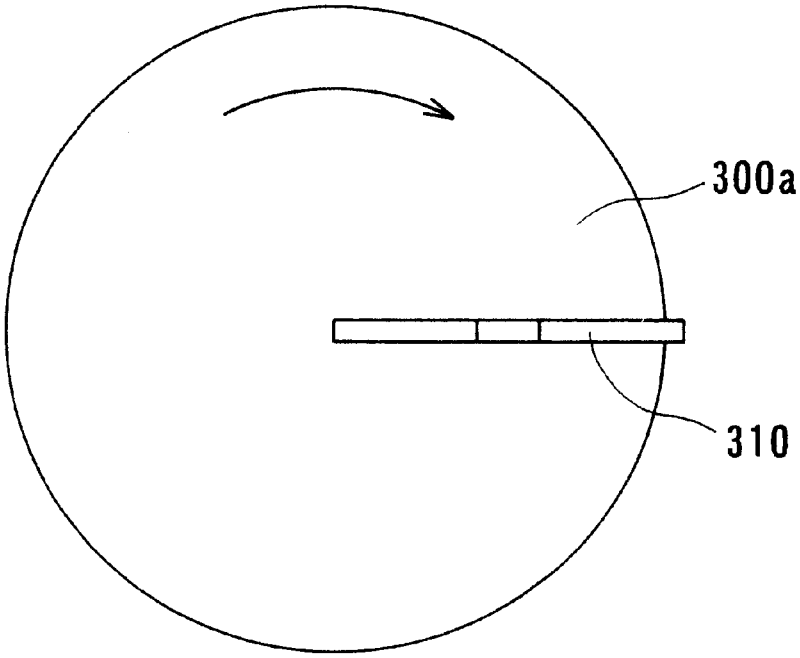
FIG. 16A is a plan view showing a dressing apparatus, and a polishing apparatus having such dressing apparatus, according to still another embodiment of the present invention.
Figure 16B:
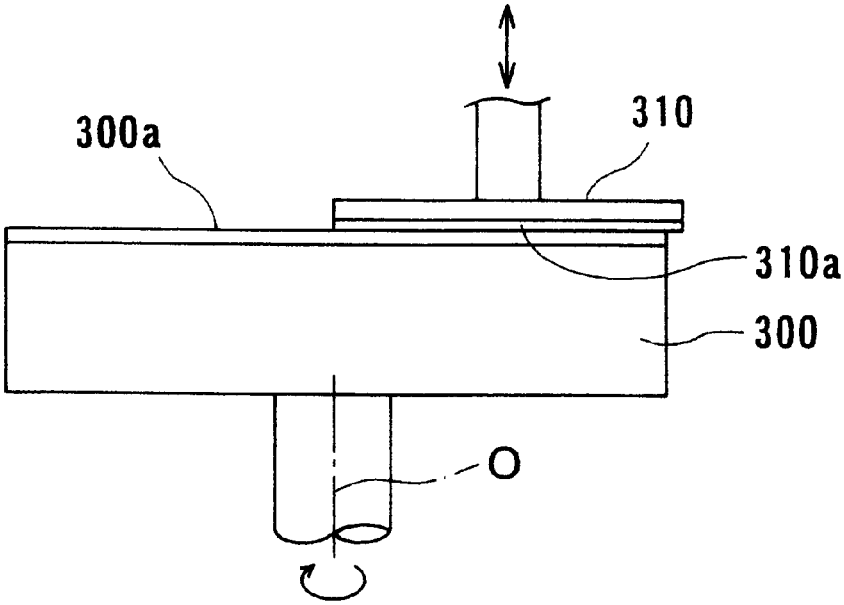
FIG. 16B is a side view showing the dressing apparatus, and the polishing apparatus having such dressing apparatus, according to the still another embodiment of the present invention.
Figure 17:
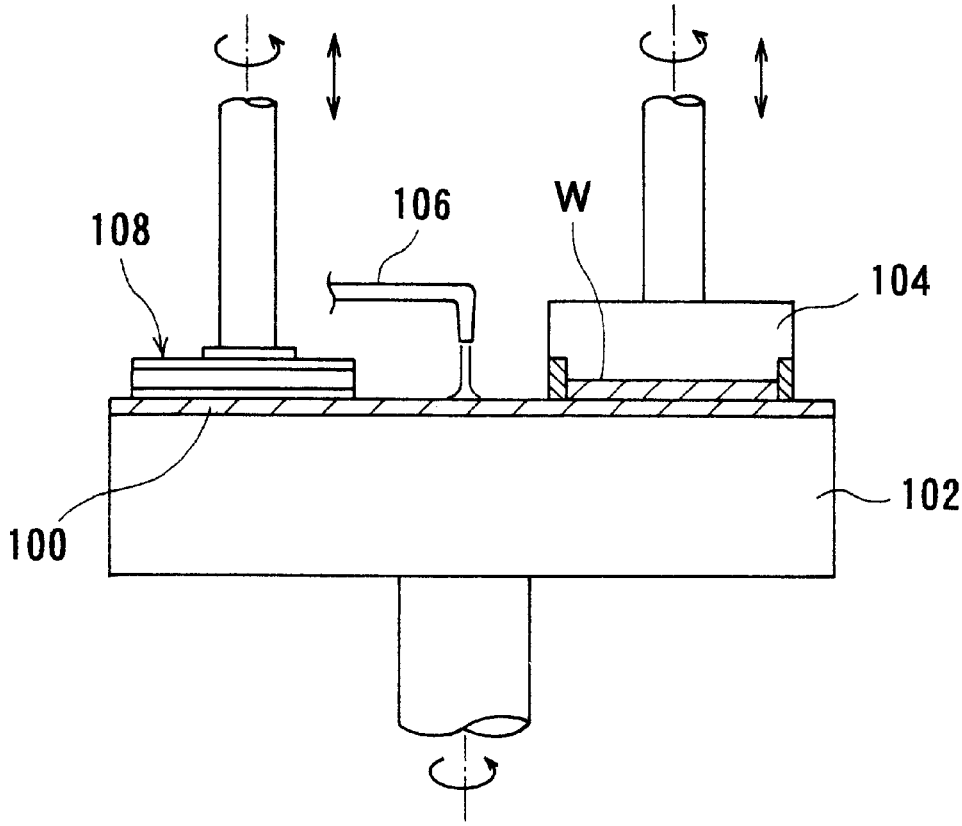
FIG. 17 is a schematic cross-sectional view of a conventional polishing apparatus.
Figure 18:
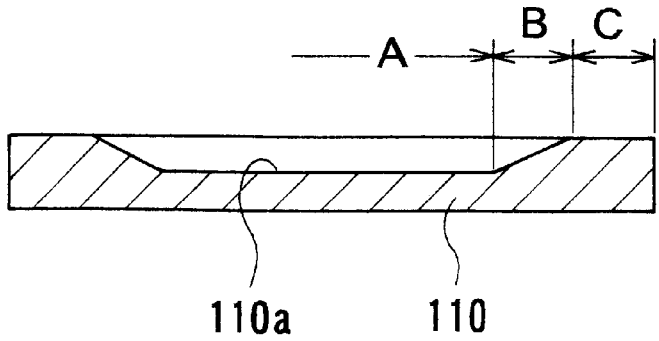
FIG. 18 is a schematic cross-sectional view showing a state of a polishing surface in the conventional polishing apparatus.

FIGS. 16A and 16B are views showing a dressing apparatus and a polishing apparatus having such dressing apparatus according to still another embodiment of the present invention. FIG. 16A is a plan view of the polishing apparatus, and FIG. 16B is a side view of the polishing apparatus. In this embodiment, a polishing table 300 comprises a rotating type turntable which rotates about its own axis 0. A polishing surface 300*a* comprising an abrading plate (fixed abrasive) or a polishing cloth is provided on an upper surface of the polishing table 300. A dresser 310 is connected to an air cylinder (not shown) and is movable vertically. During dressing, the polishing table 300 rotates about its own axis, and hence the dresser 310 is not required to be moved horizontally, and is stationary in the state shown in FIG. 16A. Therefore, if a standby position of the dresser 310 is located above the polishing table 300, then a mechanism for moving the dresser 310 horizontally is not necessary. The dressing surface 310*a* of dresser 310 has the same structure as those shown in FIGS. 7 and 8. In this embodiment also, the dresser offers the same advantages as those shown in FIGS. 7 and 8.

As described above, the present invention offers the following advantages:

(1) During dressing, a frictional force between a dressing surface and a polishing surface can be reduced. Therefore, when a dresser reciprocates, generation of vibration of the dresser can be suppressed. Further, because a boundary portion between a contact portion and a non-contact portion of the dressing surface and the polishing surface has a smooth shape, the dresser can be smoothly moved on the polishing surface.

(2) Because a long side of the dressing surface is longer than that of a moving area of the polishing surface of the polishing table, and the dresser is movable along the polishing surface by a horizontally moving mechanism, an entire area of the polishing surface can be dressed by bringing the dressing surface into contact with the polishing surface and moving the dressing surface. Therefore, even if the polishing surface has irregularities locally, the entire area of the polishing surface can be reliably planalized, and the polishing surface can be efficiently and uniformly regenerated.

(3) A polishing table which makes a scrolling motion and has an advantage with regard to space-saving can be reliably dressed by a dresser requiring a small installation area, and hence processing capability per unit installation area of the polishing table can be improved.

(4) In a case where a contact area between a dressing surface and a polishing surface is changed by relative movement between a dresser and a polishing table during dressing, a pressing force of the dresser applied to the polishing table (pressing force applied to an entire dressing surface) is changed according to the contact area, and hence a pressing force for pressing the dressing surface against the polishing surface (pressure applied to the polishing surface per unit area) can be equalized over an entire polishing surface. Thus, an amount of material removed from the polishing surface on the polishing table can be uniformized over the entire polishing surface.

(5) Inasmuch as a contact area between a dressing surface of a dresser and a polishing surface is not changed over an entire area where the dresser moves, a pressing force for pressing the dresser against the polishing surface can be constant, irrespective of a position of the dresser.

Although certain preferred embodiments of the present invention have been shown and described in detail, it should be understood that various changes and modifications may be made therein without departing from the scope of the appended claims.

The present application is based on Japanese Priority Patent Application No. 2000-350820, filed Nov. 17, 2000, the entire disclosure of which is hereby incorporated by reference.

What is claimed is:

1. A dressing apparatus for dressing a polishing surface of a polishing table that is to polish a surface of a workpiece, said dressing apparatus comprising:

a dresser having a dressing surface for dressing the polishing surface while said dresser moves along the polishing surface but does not rotate, said dressing surface including (i) a flat surface that is to contact the polishing surface, (ii) an inclined surface extending from said flat surface at an angle of from 1° to 5° so as to be directed away from the polishing surface when said flat surface is in contact with the polishing surface, and (iii) a long side that is longer than a dimension of a moving area of the polishing surface which is to be used for polishing the workpiece.

2. The dressing apparatus according to claim 1, further comprising:

a moving mechanism for moving said dresser along the polishing surface.

3. The dressing apparatus according to claim 2, wherein said dressing surface includes one of diamond particles and ceramic particles.

4. The dressing apparatus according to claim 2, further comprising:

a dresser cleaning container for cleaning said dressing surface.

5. The dressing apparatus according to claim 1, wherein said dressing surface includes one of diamond particles and ceramic particles.

6. The dressing apparatus according to claim 1, further comprising:

a dresser cleaning container for cleaning said dressing surface.

7. A dressing apparatus for dressing a polishing surface of a polishing table that is to polish a surface of a workpiece, said dressing apparatus comprising:

a dresser having a dressing surface for dressing the polishing surface; and a controller for controlling a force by which said dresser is to be pressed against the polishing surface such that the force is changed in accordance with a changing contact area between said dressing surface and the polishing surface.

8. The dressing apparatus according to claim 7, further comprising:

a dresser cleaning container for cleaning said dressing surface.

9. The dressing apparatus according to claim 7, wherein said controller is for controlling a force by which said dresser is to be pressed against the polishing surface such that pressure applied to the polishing surface via said dresser is constant per unit area.

10. A polishing apparatus for polishing a surface of a workpiece, comprising:

a polishing table that is to make a circulatory translational motion, said polishing table having a polishing surface for polishing a surface of a workpiece; and a dresser having a dressing surface for dressing said polishing surface, said dresser being translatable along said polishing surface, wherein a shape of said polishing surface is such that a contact area between said dressing surface and said polishing surface is not changed when said dresser is translated along said polishing surface.

11. The polishing apparatus according to claim 10, further comprising:

a moving mechanism for translating said dresser along said polishing surface.

12. The polishing apparatus according to claim 11, further comprising:

a dresser cleaning container for cleaning said dressing surface.

13. The polishing apparatus according to claim 11, wherein the shape of said polishing surface is partially defined by upper and lower ends of said polishing surface that are arcuate and parallel to each other.

14. The polishing apparatus according to claim 13, wherein said upper and lower ends of said polishing surface are positioned inwardly of circular arc loci defined by upper and lower ends of said dressing surface when said dresser translates along said polishing surface.

15. The polishing apparatus according to claim 10, further comprising:

a dresser cleaning container for cleaning said dressing surface.

16. The polishing apparatus according to claim 10, wherein the shape of said polishing surface is partially defined by upper and lower ends of said polishing surface that are arcuate and parallel to each other.

17. The polishing apparatus according to claim 16, wherein said upper and lower ends of said polishing surface are positioned inwardly of circular arc loci defined by upper and lower ends of said dressing surface when said dresser translates along said polishing surface.

18. A polishing apparatus for polishing a surface of a workpiece, comprising:

a polishing table that is to make a circulatory translational motion, said polishing table having a polishing surface for polishing a surface of a workpiece;

a workpiece holder for holding the workpiece and pressing the workpiece against said polishing surface; and a dresser having a dressing surface for dressing said polishing surface while said dresser translates along said polishing surface, said dressing surface including (i) a flat surface that is to contact said polishing surface, and (ii) one of (a) an inclined surface extending from said flat surface so as to be directed away from said polishing surface when said flat surface is in contact with said polishing surface, and (b) a curved surface extending from said flat surface so as to be directed away from said polishing surface when said flat surface is in contact with said polishing surface.

19. The polishing apparatus according to claim 18, further comprising:

a pressing device for causing said workpiece holder to press the workpiece against said polishing surface.

20. The polishing apparatus according to claim 19, wherein said dressing surface is for dressing said polishing surface while said dresser translates along said polishing surface at a constant speed.

21. The polishing apparatus according to claim 19, wherein said inclined surface extends from said flat surface at an angle of from 1° to 5°.

22. The polishing apparatus according to claim 18, wherein said dressing surface is for dressing said polishing surface while said dresser translates along said polishing surface at a constant speed.

23. The polishing apparatus according to claim 18, wherein said inclined surface extends from said flat surface at an angle of from 1° to 5°.

24. A polishing apparatus for polishing a surface of a workpiece, comprising:

a polishing table having a polishing surface for polishing a surface of a workpiece;

a workpiece holder for holding the workpiece and pressing the workpiece against said polishing surface;

a dresser having a dressing surface for dressing said polishing surface; and a controller for controlling a force by which said dresser is to be pressed against said polishing surface such that the force is changed in accordance with a changing contact area between said dressing surface and said polishing surface.

25. The polishing apparatus according to claim 24, further comprising:

a pressing device for causing said workpiece holder to press the workpiece against said polishing surface.

26. A dressing apparatus for dressing a polishing surface of a polishing table that is to polish a surface of a workpiece, said dressing apparatus comprising:

a dresser having a dressing surface for dressing the polishing surface; and a controller for controlling a force by which said dresser is to be pressed against the polishing surface such that the force is controlled in accordance with a change of position of said dresser.

27. The dressing apparatus according to claim 26, wherein said controller is for controlling a force by which said dresser is to be pressed against the polishing surface such that the force is controlled in accordance with a change of position of said dresser which is determined by a number of pulses of a pulse motor that is to move said dresser.

28. The dressing apparatus according to claim 26, wherein said controller is for controlling a force by which said dresser is to be pressed against the polishing surface such that the force is controlled in accordance with a change of a horizontal position of said dresser.

29. The dressing apparatus according to claim 26, wherein said controller is for controlling a force by which said dresser is to be pressed against the polishing surface such that pressure applied to the polishing surface via said dresser is constant per unit area.

30. The dressing apparatus according to claim 26, wherein said controller is for controlling a force by which said dresser is to be pressed against the polishing surface by controlling a lifting/lowering cylinder that is to lift and lower said dresser, or by controlling an electric actuator that is to lift and lower said dresser.

31. A polishing apparatus for polishing a surface of a workpiece, comprising:

a polishing table having a polishing surface for polishing a surface of a workpiece;

a workpiece holder for holding the workpiece and pressing the workpiece against said polishing surface;

a dresser having a dressing surface for dressing said polishing surface; and a controller for controlling a force by which said dresser is to be pressed against the polishing surface such that the force is controlled in accordance with a change of position of said dresser.

32. The polishing apparatus according to claim 31, further comprising:

a pressing device for causing said workpiece holder to press the workpiece against said polishing surface.

* * * * *